US009293092B2

(12) United States Patent
Guo

(10) Patent No.: US 9,293,092 B2
(45) Date of Patent: Mar. 22, 2016

(54) LIQUID CRYSTAL DISPLAY AND LIQUID CRYSTAL DISPLAY PANEL

(71) Applicant: BEIJING BOE OPTOELECTRONICS TECHNOLOGY CO., LTD., Beijing (CN)

(72) Inventor: Rui Guo, Beijing (CN)

(73) Assignee: BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 56 days.

(21) Appl. No.: 14/125,217

(22) PCT Filed: Dec. 4, 2012

(86) PCT No.: PCT/CN2012/085867

§ 371 (c)(1),
(2) Date: Dec. 10, 2013

(87) PCT Pub. No.: WO2013/163876

PCT Pub. Date: Nov. 7, 2013

(65) Prior Publication Data

US 2014/0111410 A1 Apr. 24, 2014

(30) Foreign Application Priority Data

May 4, 2012 (CN) ..... 2012 1 0138142

(51) Int. Cl.

| | |
|---|---|
| ***G09G 3/36*** | (2006.01) |
| ***G09G 3/20*** | (2006.01) |
| *G09G 3/00* | (2006.01) |

(52) U.S. Cl.

CPC ..... *G09G 3/3611* (2013.01); *G09G 3/2003* (2013.01); *G09G 3/3607* (2013.01); *G09G 3/3614* (2013.01); *G09G 3/003* (2013.01); *G09G 3/3688* (2013.01); *G09G 2300/0426* (2013.01)

(58) Field of Classification Search

CPC ..... G09G 3/003; G09G 3/2003; G09G 3/3607–3/3614; G09G 3/3648; G09G 3/3666; G09G 3/3674; G09G 3/3677; G09G 3/3685; G09G 3/3688; G09G 2300/0421; G09G 2300/0426; G09G 2300/0439; G09G 2300/0452

USPC ..... 345/87–103

See application file for complete search history.

(56) References Cited

U.S. PATENT DOCUMENTS

| | | | | |
|---|---|---|---|---|
| 2002/0113764 | A1 * | 8/2002 | Yamada et al. | 345/88 |
| 2004/0145581 | A1 | 7/2004 | Morita | |

(Continued)

FOREIGN PATENT DOCUMENTS

| | | | |
|---|---|---|---|
| CN | 1503214 | A | 6/2004 |
| CN | 202075968 | U | 12/2011 |

(Continued)

OTHER PUBLICATIONS

International Search Report for International Application No. PCT/CN2012/085867, 14pgs., Issued Mar. 14, 2013.

PCT International Preliminary Report on Patentability for International Application No. PCT/CN2012/085867, rendered Nov. 14, 2014; 10 pgs.

First Office Action from the State Intellectual Property Office of the People's Republic of China for Chinese Patent Application No. 201210138142.5 , rendered Mar. 19, 2015, 5 pgs.

(Continued)

*Primary Examiner* — Nathan Danielsen

(74) *Attorney, Agent, or Firm* — Ladas & Parry LLP

(57) ABSTRACT

A liquid crystal display and liquid crystal display panel (101). The liquid crystal display panel (101) includes: several data lines, several scan lines, several sub-pixel arranged in a matrix form. Three scan lines are formed between every two rows of sub-pixels. One data line is formed respectively on the two sides of the first column of the sub-pixels in every three adjacent columns of the sub-pixels. Therefore, the charging time of the pixels can be improved while the high display quality is satisfied.

15 Claims, 10 Drawing Sheets

(56) References Cited

U.S. PATENT DOCUMENTS

| | | | | |
|---|---|---|---|---|
| 2010/0123843 | A1 | 5/2010 | Kim et al. | |
| 2012/0139892 | A1 * | 6/2012 | Oh et al. | 345/87 |

FOREIGN PATENT DOCUMENTS

| | | | |
|---|---|---|---|
| CN | 102799036 | A | 11/2012 |
| CN | 102914923 | A | 2/2013 |

OTHER PUBLICATIONS

English translation of First Office Action from the State Intellectual Property Office of the People's Republic of China for Chinese Patent Application No. 201210138142.5 , rendered Mar. 19, 2015, 3 pgs.

English Abstract of CN1503214A (listed above under Foreign Patent Documents); 1pg., Jun. 9, 2004.

Second Chinese Office Action Appln. No. 201210138142.5; Dated Aug. 12, 2015.

* cited by examiner

LIQUID CRYSTAL DISPLAY AND LIQUID CRYSTAL DISPLAY PANEL

CROSS REFERENCE TO RELATED APPLICATIONS

This application is based on International Application No. PCT/CN2012/085867 filed on Dec. 4, 2012, which claims priority to Chinese National Application No. 201210138142.5 filed on May 4, 2012, the contents of which are incorporated herein by reference.

TECHNICAL FIELD

Embodiments of the present invention relate to a display and a display panel.

BACKGROUND

At present, the structure of a liquid crystal display device is illustrated in FIG. 1 mainly includes a display panel provided with a sub-pixel array, a source driver for driving sources of sub-pixels and having data lines, a gate driver for driving gates of sub-pixels and having scan lines, a timing controllers and a backlight unit.

For liquid crystal display devices in prior art, in order to reduce costs, a dual-gate technology and a triple-gate technology are adopted, that is, to increase gate lines to 2 or 3 times or more. Although these two solutions can reduce costs, but reduce charging time of pixels significantly, therefore they can not satisfy requirements for high resolution and charging time of pixels in 3D display.

SUMMARY

Embodiments of the present invention provide a display and a display panel capable of satisfying high quality requirement and improving pixel charging time as well.

One aspect of the present invention provides a display panel including: a plurality of data lines, a plurality of scan lines and a plurality of sub-pixels arranged in matrix; wherein three rows of scan lines are disposed between every two rows of sub-pixels; one column of data line is disposed for every one column or between two columns of sub-pixels.

In the above-mentioned display panel, for example, one data line may be disposed on each of left and right sides of the first column of sub-pixels in 3 adjacent columns of sub-pixels.

In the above-mentioned display panel, for example, the number of data lines may be less than or equal to ⅔ of the number of sub-pixels in row direction; and the number of scan lines may be greater than or equal to 3/2 of the number of sub-pixels in column direction.

In the above-mentioned display panel, for example, a first scan line in every 3 adjacent scan lines may be connected with a first sub-pixel in every 3 adjacent sub-pixels in an odd numbered row and an even numbered row of sub-pixels neighboring the first scan line; a second scan line in every 3 adjacent scan lines may be connected with a second sub-pixel in every 3 adjacent sub-pixels in the odd numbered row and the even numbered row of sub-pixels neighboring the second scan line; and a third scan line in every 3 adjacent scan lines may be connected with a third sub-pixel in every 3 adjacent sub-pixels in the odd numbered row and the even numbered row of sub-pixels neighboring the third scan line.

In the above-mentioned display panel, for example, an odd numbered column of data lines may be connected with every 3 adjacent sub-pixels in an odd numbered row of sub-pixels, and an even numbered column of data lines may be connected with every 3 adjacent sub-pixels in an even numbered row of sub-pixels.

In the above-mentioned display panel, for example, an odd numbered column of data lines may be connected with a first and a third sub-pixels in every 3 adjacent sub-pixels in an odd numbered row of sub-pixels and a second sub-pixel in every 3 adjacent sub-pixels in an even numbered row of sub-pixels; and an even numbered column of data lines may be connected with a first and a third sub-pixels in the every 3 adjacent sub-pixels in the even numbered row of sub-pixels and a second sub-pixel in the every 3 adjacent sub-pixels in the odd numbered row of sub-pixels.

In the above-mentioned display panel, for example, a group of n rows and m columns of sub-pixels corresponds to n rows and M*m columns of sub-pixel in matrix; for the sub-pixels of the $i^{th}$ and the $i+1^{th}$ lines, the $3j+1^{th}$ column of sub-pixels may be connected with the $(3i-1)/2^{th}$ scan line G ((3i−1)/2), the $3j+2^{th}$ column of sub-pixels may be connected with the $(3i+1)/2^{th}$ scan line G ((3i+1)/2), and the $3j+3^{th}$ column of sub-pixels may be connected with the $(3i+3)/2^{th}$ scan line G ((3i+3)/2); wherein n is an even number, i is an odd number greater than or equal to 1 and less than or equal to n−1, j is an integer greater than or equal to 0 and less than or equal to (M*m/3)−1, and M equals to the number of primary colors of the display panel.

In the above-mentioned display panel, for example, the display panel may use three primary colors of red, green and blue, four primary colors of red, green, blue and white, four primary colors of red, green, blue and yellow or five primary colors of red, green, blue, yellow and white, and M equals 3, 4 or 5.

In the above-mentioned display panel, for example, the odd numbered column of data lines being connected with the every 3 adjacent sub-pixels in the odd numbered row of sub-pixels and the even numbered column of data lines being connected with the every 3 adjacent sub-pixels in the even numbered row of sub-pixels comprises: the $2k-1^{th}$ data line S(2k−1) may be connected with sub-pixels of the $3k-2^{th}$, $3k-1^{th}$ and $3k^{th}$ columns of the odd numbered row of sub-pixels in the sub-pixel matrix; the $2k^{th}$ data line S(2k) may be connected with sub-pixels of the $3k-2^{th}$, $3k-1^{th}$ and $3k^{th}$ columns of the even numbered rows of sub-pixels in the sub-pixel matrix, wherein k is an integer greater than or equal to 1 and less than or equal to M*m/3.

In the above-mentioned display panel, for example, the $2k-1^{th}$ data line S(2k−1) may be connected with the sub-pixels of the $3k-2^{th}$ and $3k^{th}$ columns of the odd numbered rows of sub-pixels and the sub-pixels of the $3k-1^{th}$ column of the even numbered rows of sub-pixels in the sub-pixel matrix; the $2k^{th}$ data line S(2k) may be connected with the sub-pixels of the $3k-1^{th}$ column of the odd numbered rows of sub-pixels, and the sub-pixels of the $3k-2^{th}$ and the $3k^{th}$ columns of the even numbered rows of sub-pixels in the sub-pixel matrix, wherein k is an integer greater than or equal to 1 and less than or equal to M*m/3.

In the above-mentioned display panel, for example, in the same frame of picture, pixels on a same data line have a same polarity, pixels on the $4g-3^{th}$ and the $4g-2^{th}$ data lines have opposite polarities to each other, pixels on the $4g-1^{th}$ and the 4gth data lines have opposite polarities to each other, pixels on the $4g-3^{th}$, the $4g-2^{th}$, the $4g-1^{th}$ and 4gth data lines have polarities of "positive, negative, negative, positive" or "negative, positive, positive negative", and g is an integer greater than or equal to 1 and less than or equal to M*m/6.

For example, in a current frame of picture and a next frame picture, pixels on the same data lines have opposite polarities.

For example, this display panel further includes a timing control circuit; in a frame of picture, when the timing control circuit controls the $1^{st}$ scan line in every 3 adjacent scan lines to turn on, an odd numbered column of data lines writes data into the $1^{st}$ sub-pixel in the every 3 adjacent sub-pixels in an odd numbered row of sub-pixels connected with the $1^{st}$ scan line, an even numbered column of data lines writes data into the $1^{st}$ sub-pixel in the every 3 adjacent sub-pixels in an even numbered row of sub-pixels connected with the $1^{st}$ scan line; when the timing control circuit controls the $2^{nd}$ scan line in the every 3 adjacent scan lines to turn on, the odd numbered column of data lines writes data into the $2^{nd}$ sub-pixel in the every 3 adjacent sub-pixels in the odd numbered row of sub-pixels connected with the $2^{nd}$ scan line, the even numbered column of data lines writes data into the $2^{nd}$ sub-pixel in the every 3 adjacent sub-pixels in the even numbered row of sub-pixels connected with the $2^{nd}$ scan line; when the timing control circuit controls the $3^{rd}$ scan line in every 3 adjacent scan lines to turn on, the odd numbered column of data lines writes data into the $3^{rd}$ sub-pixel in the every 3 adjacent sub-pixels in the odd numbered row of sub-pixels connected with the $3^{rd}$ scan line, the even numbered column of data lines writes data into the $3^{rd}$ sub-pixel in the every 3 adjacent sub-pixels in the even numbered row of sub-pixels connected with the $3^{rd}$ scan line.

As another example, this display panel further includes a timing control circuit; in a frame of picture, when the timing control circuit controls the $1^{st}$ scan line in every 3 adjacent scan lines to turn on, an odd numbered column of data lines writes data into the $1^{st}$ sub-pixel in the every 3 adjacent sub-pixels in an odd numbered row of sub-pixels connected with the $1^{st}$ scan line, an even numbered column of data lines writes data into the $1^{st}$ sub-pixel in the every 3 adjacent sub-pixels in an even numbered row of sub-pixels connected with the $1^{st}$ scan line; when the timing control circuit controls the $2^{nd}$ scan line in the every 3 adjacent scan lines to turn on, the odd numbered column of data lines writes data into the $2^{nd}$ sub-pixel in the every 3 adjacent sub-pixels in the odd numbered row of sub-pixels connected with the 2nd scan line, the even numbered column of data lines writes data into the 2nd sub-pixel in the every 3 adjacent sub-pixels in the even numbered row of sub-pixels connected with the $2^{nd}$ scan line; when the timing control circuit controls the $3^{rd}$ scan line in every 3 adjacent scan lines to turn on, the odd numbered column of data lines writes data into the $3^{rd}$ sub-pixel in the every 3 adjacent sub-pixels in the odd numbered row of sub-pixels connected with the $3^{rd}$ scan line, the even numbered column of data lines writes data into the $3^{rd}$ sub-pixel in the every 3 adjacent sub-pixels in the even numbered row of sub-pixels connected with the 3rd scan line.

In the above-mentioned display panel, for example, the inversion mode for the sub-pixel is dot inversion.

The present invention further provides a display including the above-mentioned display panel; the display further includes: a source driver and a gate driver; the source driver is connected with the data line for providing data signal to the display panel; the gate driver is connected with the scan lines for providing scanning signal to the display panel.

In embodiments of the present invention, the display panel includes: a plurality of data lines, a plurality of scan lines and a plurality of sub-pixels arranged in matrix; three rows of scan lines being disposed between every two rows of sub-pixels; one column of data line being disposed for every one column or between two columns of sub-pixels. Thus, when the scan lines of the gate driver are turned on, sub-pixel data of the $i^{th}$ and the $i+1^{th}$ rows are written into corresponding sub-pixels through respective data lines, and therefore, the gate driver units becomes 1.5 times more than the gate driver units in prior art, increasing pixel charging time with respect to dual gate technology and triple gate technology. At the same time, the number of data lines is ⅔ of the original number of data lines, which reduces costs with respect to prior art. Further, scan lines of corresponding sub-pixels in every two rows of pixels are connected together, which can reduce the amount of existing parasitic capacitance and parasitic resistance. Therefore, the driving voltage required to ensure the scan lines for the last column of sub-pixels can be normally turned on is small, which facilitates power consumption reduction. At the same time, with comparison to the Dual-Gate technology and the Triple-Gate technology, the technical solution of embodiments of the present invention can increase charging time of pixels.

In summary, with comparison to prior art, pixel charging time is increased, power consumption is reduced, and thus stringent demands for pixel charging time by 3D and high resolution products in the future development trends and high quality requirements for 240 Hz frame frequency 3D high resolution display can be met.

BRIEF DESCRIPTION OF DRAWINGS

For better understanding technical proposals according to embodiments of the present invention, drawings of the embodiments will be described briefly below. Obviously, drawings in the following description only relate to some embodiments of the present invention, not to limit the present invention.

Figure 1:
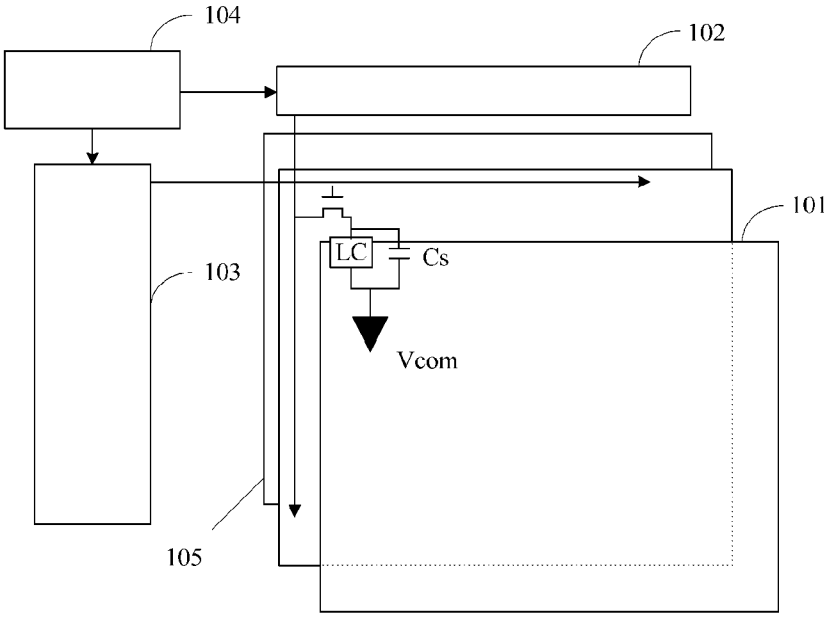
FIG.1 (Prior Art)
FIG. 1 is a structural representation of implementing a liquid crystal display in prior art.

Reference numerals: 101: liquid crystal display panel; 102: source driver; 103: gate driver; 104: timing controller; 105: backlight unit

DETAIL DESCRIPTION

In order to make the purpose, technology solution and advantages of embodiments of the present invention more clear, technology solutions according to embodiments of the present invention will be described clearly and completely below with respect to drawings of embodiments of the present invention. It is to be understood that the described embodiments are part of but not all of embodiments of the present invention. Based on the described embodiments of the present invention, all other embodiments obtained by those of ordinary skill in the art without any creative labor fall into the protecting scope of the present invention.

Unless otherwise defined, all the technical and scientific terms used herein have the same meanings as commonly understood by one of ordinary skill in the art to which the present invention belongs. The terms "first," "second," etc., which are used in the description and the claims of the present application for invention, are not intended to indicate any sequence, amount or importance, but distinguish various components. Also, the terms such as "a," "an," etc., are not intended to limit the amount, but indicate the existence of at lease one. The terms "comprises," "comprising," "includes," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

The display panel according to an embodiment of the present invention includes: a plurality of data lines, a plurality of scan lines, a plurality of sub-pixels arranged in matrix form; three (3) row scanning lines disposed between every two rows of sub-pixels; and one (1) column data line disposed between every one or every two columns of sub-pixels.

FIG. 1 is a structural representation of implementing a liquid crystal display in prior art. As illustrated in FIG. 1, this liquid crystal display includes a liquid crystal display panel 101 provided with a sub-pixel array, a source driver 102, a gate driver 103, a timing controller 104 and a backlight unit 105. The source driver 102 is connected with the liquid crystal display panel 101 and the data lines, for providing data signals to the liquid crystal display panel. The gate driver 103 is connected with the liquid crystal display panel 101 and the scan lines, for providing scanning signals to the liquid crystal display panel. The timing controller 104 is connected with the source driver 102 and the gate driver 103, for controlling operation of the source driver 102 and the gate driver 103. The backlight unit 105 is configured to provide a backlight source required by the liquid crystal display panel 101.

In an embodiment of the present invention, 3 row scanning lines are disposed between every two rows of adjacent sub-pixels; and 1 column data line is disposed for every one column or between two columns of sub-pixels. One data line is disposed on each of the left and right sides of the first column of pixels in 3 adjacent columns of sub-pixels.

The number of the data lines is less than or equal to ⅔ of the number of the sub-pixels in the row direction; the number of the scan lines is greater than or equal to 3/2 of the number of the sub-pixels in the column direction. Since integrated circuits (ICs) for source driver are expensive, with comparison to the prior art, the number of ICs for the source driver can be reduced and the costs can be lowered. The first scan line in every 3 adjacent scan lines is connected with the first sub-pixel in every 3 adjacent sub-pixels in the odd numbered row and the even numbered row of sub-pixels neighboring this scan line. The second scan line in the every 3 adjacent scan lines is connected with the second sub-pixel in every 3 adjacent sub-pixels in the odd numbered row and the even numbered row of sub-pixels neighboring this scan line. The third scan line in the every 3 adjacent scan lines is connected with the third sub-pixel in every 3 adjacent sub-pixels in the odd numbered row and the even numbered row of sub-pixels neighboring this scan line.

An odd numbered column of data lines is connected with every 3 adjacent sub-pixels in odd numbered rows of sub-pixels, and an even numbered column of data lines is connected with every 3 adjacent sub-pixels in even numbered rows of sub-pixels. Or, an odd numbered column of data lines is connected with the first and the third sub-pixels in every 3 adjacent sub-pixels in odd numbered rows of sub-pixels and the second sub-pixel in every 3 adjacent sub-pixels in even numbered row of sub-pixels; an even numbered column of data lines is connected with the first and the third sub-pixels in every 3 adjacent sub-pixels in even numbered rows of sub-pixels and the second sub-pixel in every 3 adjacent sub-pixels in odd numbered row of sub-pixels.

Description will be given below with a liquid crystal display with resolution of m*n as an example. There are n rows by m columns of sub-pixels on the liquid crystal display panel 101 of the liquid crystal display with a resolution of m*n. Three primary colors red green blue (RGB), four primary colors red green blue white (RGBW), four primary colors red green blue yellow (RUBY) and five primary colors red green blue yellow white (RGBYW) may be used. Correspondingly, there are n rows by M*m columns of sub-pixels on the liquid crystal display panel 101, where M equals to the number of primary colors, i.e., one of 3, 4 or 5.

The liquid crystal display panel 101 has a plurality of data lines, a plurality of scan lines and a plurality of pixels arranged in matrix. The source driver 102 is configured to drive the sources of the sub-pixels, and the gate driver 103 is configured to drive the gates of sub-pixels.

In an embodiment of the present invention, in the n rows by m columns of sub-pixels, for the sub-pixels of the $i^{th}$ and the $i+1^{th}$ rows, the $3j+1^{th}$ column of sub-pixels are connected with the $(3i-1)/2^{th}$ scan line G ((3i−1)/2), the $3j+2^{th}$ column of sub-pixels are connected with the $(3i+1)/2^{th}$ scan line G ((3i+1)/2), and the $3j+3^{th}$ column of sub-pixels are connected with the $(3i+3)/2^{th}$ scan line G ((3i+3)/2); wherein n is an even number, i is an odd number greater than or equal to 1 and less than or equal to n−1, and j is an integer greater than or equal to 0 and less than or equal to (M*m/3)−1.

At the same time, data lines are connected in the following two modes.

First mode. The $2k-1^{th}$ data line S(2k−1) is connected with the sub-pixels of the $3k-2^{th}$, $3k-1^{th}$ and $3k^{th}$ columns of the odd numbered rows of sub-pixels in the sub-pixel matrix; the 2kth data line S(2k) is connected with the sub-pixels of the $3k-2^{th}$, $3k-1^{th}$ and $3k^{th}$ columns of the even numbered rows of sub-pixels in the sub-pixel matrix, wherein k is an integer greater than or equal to 1 and less than or equal to M*m/3.

Second mode. The $2k-1^{th}$ data line S(2k−1) is connected with the sub-pixels of the $3k-2^{th}$ and $3k^{th}$ columns of the odd numbered rows of sub-pixels and the sub-pixels of the $3k-1^{th}$ column of the even numbered rows of sub-pixels in the sub-pixel matrix; the $2k^{th}$ data line S(2k) is connected with the sub-pixels of the $3k-1^{th}$ columns of the odd numbered rows of sub-pixels, and the sub-pixels of the $3k-2^{th}$ and $3k^{th}$ columns of the even numbered rows of sub-pixels in the sub-pixel matrix, wherein k is an integer greater than or equal to 1 and less than or equal to M*m/3.

In the embodiment of the present invention, the number of scan lines is 1.5n, and the number of data lines is 2M*m/3. With comparison to the prior art solution with n scan lines by M*m data lines, the number of scan lines in the embodiment of the present invention is increased by 1.5 times, while the number of data lines is decreased by ⅔, therefore the costs are reduced with respect to the prior art solution. Furthermore, the scan lines of corresponding sub-pixels in every two rows of pixels in the embodiment of the present invention are connected together, which produces less parasitic capacitance and parasitic resistance with comparison to the technical solution of the Publication No. CN101494020; and in order to ensure scan lines for the last column of sub-pixels can be normally turned on, the required driving voltage is small, which is advantageous for reducing power consumption. At the same time, with comparison to the Dual-Gate technology and the Triple-Gate technology, the technical solution of the embodiment of the present invention can increase charging time of pixels. In summary, embodiments of the present invention can compromise among pixel charging time, cost and power consumption.

Embodiment I

Figure 2:
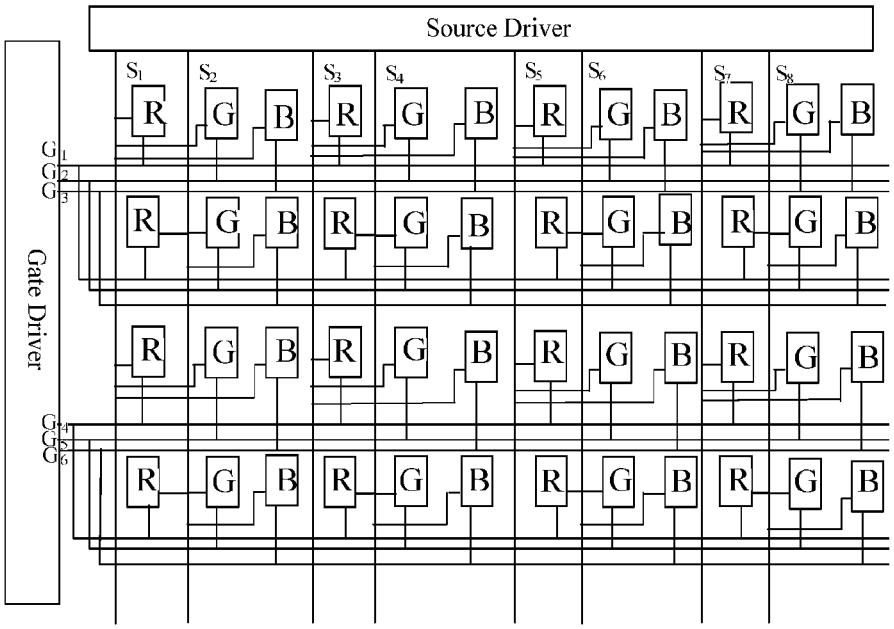
FIG. 2 is a first schematic diagram of a sub-pixel array where adopting red green and blue three primary colors in the present invention.

As illustrated in FIG. 2, in this embodiment, taking a liquid crystal display of three primary colors RGB and with a resolution of n*m as an example, that is, m equals to 3, a pixel group of n rows by m columns corresponds to sub-pixels of n rows by 3m columns. The RGB sub-pixels of a same pixel are arranged horizontally to form a pixel group. The following embodiments are similar in this arrangement. There are totally 1.5n scan lines and 2m data lines.

For the sub-pixels of the $i^{th}$ and the $i+1^{th}$ rows, the $3j+i^{th}$ column of sub-pixels are connected with the $(3i-1)/2^{th}$ scan line G ((3i−1)/2), the $3j+2^{th}$ column of sub-pixels are connected with the $(3i+1)/2^{th}$ scan line G ((3i+1)/2), and the $3j+3^{th}$ column of sub-pixels are connected with the $(3i+3)/2^{th}$ scan line G ((3i+3)/2); wherein i is an odd number greater than or equal to 1 and less than or equal to n−1, and j is an integer greater than or equal to 0 and less than or equal to m−1. At the same time, the $2k-1^{th}$ data line S(2k−1) is connected with the sub-pixels of the $3k-2^{th}$, $3k-1^{th}$ and $3k^{th}$ columns of the odd numbered rows of sub-pixels in the sub-pixel matrix; The $2k^{th}$ data line S(2k) is connected with the sub-pixels of the $3k-2^{th}$, $3k-1^{th}$ and $3k^{th}$ columns of the even numbered rows of the sub-pixels in the sub-pixel matrix, wherein k is an integer greater than or equal to 1 and less than or equal to m. FIG. 2 is only a partial schematic diagram of the pixel matrix showing 6 scan lines and 8 data lines, however the scope of the present embodiment is not limited thereto.

The implementation of a frame of picture includes the following process.

When G1 is turned on, the sub-pixel data for the $1^{st}$ and $2^{nd}$ lines are written into corresponding sub-pixels through respective data lines; for example, the red sub-pixel data $R_{1,1}$ of the $1^{st}$ row, $1^{st}$ column are output over S1, the red sub-pixel data $R_{2,1}$ of the $2^{nd}$ row, $1^{st}$ column are output over S2, . . . , the red sub-pixel data $R_{1,m}$ of the $1^{st}$ row, $m^{th}$ column are output over S(2m−1), and the red sub-pixel data $R_{2,m}$ of the $2^{nd}$ row, $m^{th}$ column are output over S(2m).

When G2 is turned on, the sub-pixel data for the $1^{st}$ and $2^{nd}$ rows are written into corresponding sub-pixels through respective data lines. For example, the green sub-pixel data $G_{1,1}$ of $1^{st}$ row, $1^{st}$ column are output over S1, the green sub-pixel data of $2^{nd}$ row, $1^{st}$ column $G_{2,1}$ are output over S2, . . . , the green sub-pixel data $G_{1,m}$ of $1^{st}$ row, $m^{th}$ column are output over S(2m−1), and the green sub-pixel data $G_{2,m}$ of $2^{nd}$ row, $m^{th}$ column are output over S(2m).

When G3 is turned on, the sub-pixel data for the 1st and 2nd rows are written into corresponding sub-pixels through respective data lines. For example, the blue sub-pixel data $B_{1,1}$ of $1^{st}$ row, $1^{st}$ column are output over S1, the blue sub-pixel data $B_{2,1}$ of $2^{nd}$ row, $1^{st}$ column are output over S2, . . . , the blue sub-pixel data $B_{1,m}$, of $1^{st}$ row, $m^{th}$ column are output over S(2m−1), and the blue sub-pixel data $B_{2,m}$ of $2^{nd}$ row, $m^{th}$ column are output over S(2m).

. . .

When G(1.5n−2) is turned on, the sub-pixel data for the $n-1^{th}$ and nth rows are written into corresponding sub-pixels through respective data lines. For example, the red sub-pixel data $R_{n-1,1}$ of $n-1^{th}$ row, $1^{st}$ column are output over S1, the red sub-pixel data $R_{n,1}$ of $n^{th}$ row, $1^{st}$ column are output over S2, the red sub-pixel data $R_{n-1,m}$, $n-1^{th}$ row, $m^{th}$ column are output over S(2m−1), and the red sub-pixel data $R_{n,m}$ of $n^{th}$ row, $m^{th}$ column are output over S(2m).

When G(1.5n−1) is turned on, the sub-pixel data for the $n-1^{th}$ and $n^{th}$ rows are written into corresponding sub-pixels through respective data lines. For example, the green sub-pixel data $G_{n-1,1}$ of $n-1^{th}$ row, $1^{st}$ column are output over S1, the green sub-pixel data $G_{n,1}$ of $n^{th}$ row, $1^{st}$ column are output over S2, the green sub-pixel data $G_{n-1,m}$ of $n-1^{th}$ row, $m^{th}$ column are output over S(2m−1), and the green sub-pixel data. $G_{n,m}$ of $n^{th}$ row, $m^{th}$ column are output over S(2m).

When G(1.5n) is turned on, the sub-pixel data for the $n-1^{th}$ and $n^{th}$ rows are written into corresponding sub-pixels through respective data lines. For example, the blue sub-pixel data $B_{n-1,1}$ of $n-1^{th}$ row, $1^{st}$ column are output over S1, the blue sub-pixel data $B_{n,1}$ of $n^{th}$ row, $1^{st}$ column are output over S2, the blue sub-pixel data $B_{n-1,m}$ of $n-1^{th}$ row, $m^{th}$ column are output over S(2m−1), and the blue sub-pixel data $B_{n,m}$ of $n^{th}$ row, $m^{th}$ column are output over S(2m).

As can be seen from the above-described process, in a frame of picture, when the timing control circuit controls the $1^{st}$ scan line in every 3 adjacent scan lines to turn on, an odd numbered column of data lines writes data into the $1^{st}$ sub-pixel in the every 3 adjacent sub-pixels in an odd numbered row of sub-pixels connected with the $1^{st}$ scan line, and an even numbered column of data lines writes data into the $1^{st}$ sub-pixel in the every 3 adjacent sub-pixels in an even numbered row of sub-pixels connected with the $1^{st}$ scan line. As can be seen in FIG. 2, all R sub-pixels in the two rows of sub-pixels adjacent to the turned-on scan line from above and below are written with data.

When the timing control circuit controls the $2^{nd}$ scan line in the every 3 adjacent scan lines to turn on, the odd numbered column of data lines writes data into the $2^{nd}$ sub-pixel in the every 3 adjacent sub-pixels in the odd numbered row of sub-pixels connected with the 2nd scan line, and the even numbered column of data lines writes data into the $2^{nd}$ sub-pixel in the every 3 adjacent sub-pixels in the even numbered row of sub-pixels connected with the 2nd scan line. As can be seen in FIG. 2, all G sub-pixels in the two rows of sub-pixels adjacent to the turned-on scan line from above and below are written with data.

When the timing control circuit controls the $3^{rd}$ scan line in every 3 adjacent scan lines to turn on, the odd numbered column of data lines writes data into the $3^{rd}$ sub-pixel in the every 3 adjacent sub-pixels in the odd numbered row of sub-pixels connected with the $3^{rd}$ scan line, and an even numbered column of data lines writes data into the $3^{rd}$ sub-pixel in the every 3 adjacent sub-pixels in the even numbered row of sub-pixels connected with the 3rd scan line. As can be seen in FIG. 2, all B sub-pixels in the two rows of sub-pixels adjacent to the turned-on scan line from above and below are written with data.

Data writing modes in the following embodiments III and V are the same as embodiment I.

It is assumed that the frame frequency is 60 Hz, charging time for each pixel unit (i.e., sub-pixel) of the dual-gate driven liquid crystal display device is 1/(60*2n)s, and charging time for each pixel unit of the triple-gate driven liquid crystal display device is 1/(60*3n)s. While in this example, the charging time for each pixel unit of the liquid crystal display device is 1/(60*1.5n)s.

Figure 3:
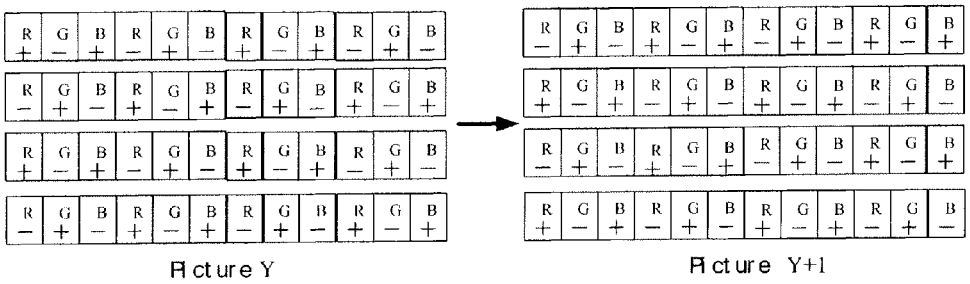
FIG. 3 is a comparison schematic diagram of pixel polarity reversal for two adjacent frames of pictures where adopting red green and blue three primary colors in the present invention.
Figure 4:
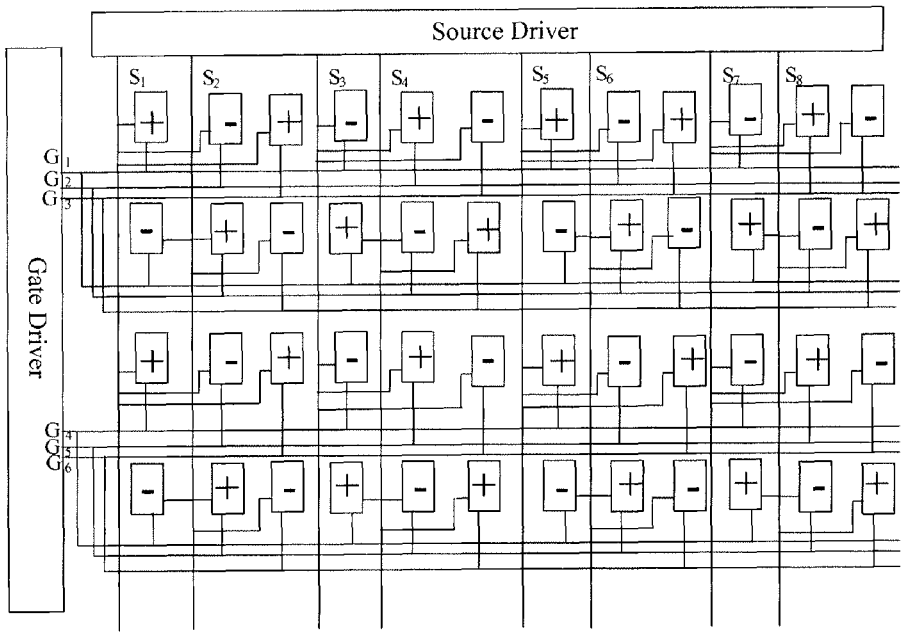
FIGS. 4 and 5 are a pixel array schematic diagram of pixel polarity reversal for two adjacent frames of pictures where adopting red green and blue three primary colors in the present invention.
Figure 5:
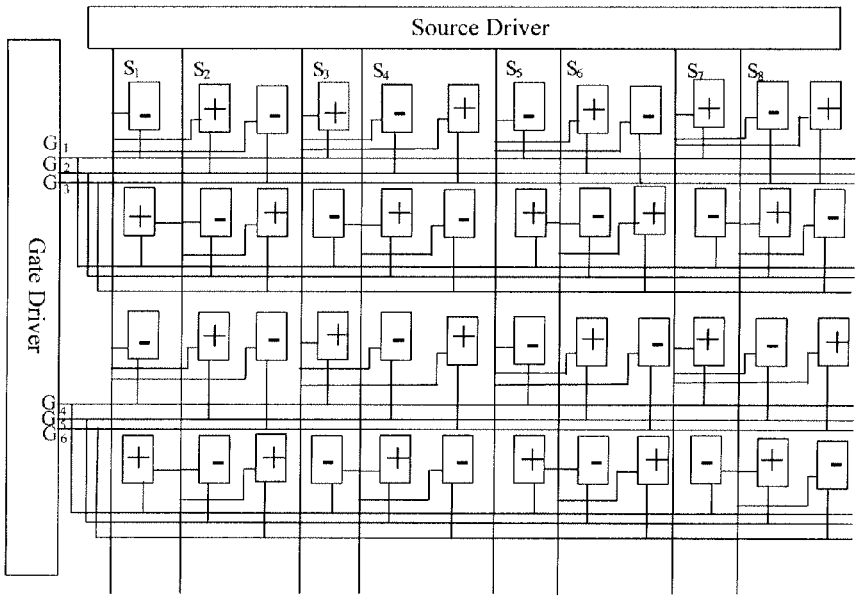

To reduce twinkling, as illustrated in FIG. 3, the inversion mode of an entire picture is dot inversion. Dot inversion means that when writing of one frame of picture is completed and before the next frame of picture is written, the voltage polarity stored by each sub-pixel is opposite to that of the adjacent upper, lower, left and right sub-pixels, while voltage polarities stored in a same sub-pixel of two adjacent frames are also opposite to each other. As to the liquid crystal display panel as illustrated in FIG. 2, if dot inversion is adopted, the data line needs to be inversed for several times for displaying one frame of picture. As illustrated in FIGS. 4 and 5. "+" and "−" labeled on pixels denote the polarities of the pixels. When G1 is turned on, in order to charge the red sub-pixel of 1st row, 1st column in the pixel group, the polarity of S1 is positive. When G2 is turned on, in order to charge the green sub-pixel of 1st row, 1st column in the pixel group, the polarity on S1 is negative. When G3 is turned on, in order to charge the blue sub-pixel of 1st row, 1st column in the pixel group, the polarity on S1 is positive. Frequent polarity inversion on the data lines consumes a large amount of energy and the consumed energy will be converted into heat to heat the driving circuits, which is disadvantageous for the life of liquid crystal display. The following embodiment II can solve this problem.

Embodiment II

Figure 6:
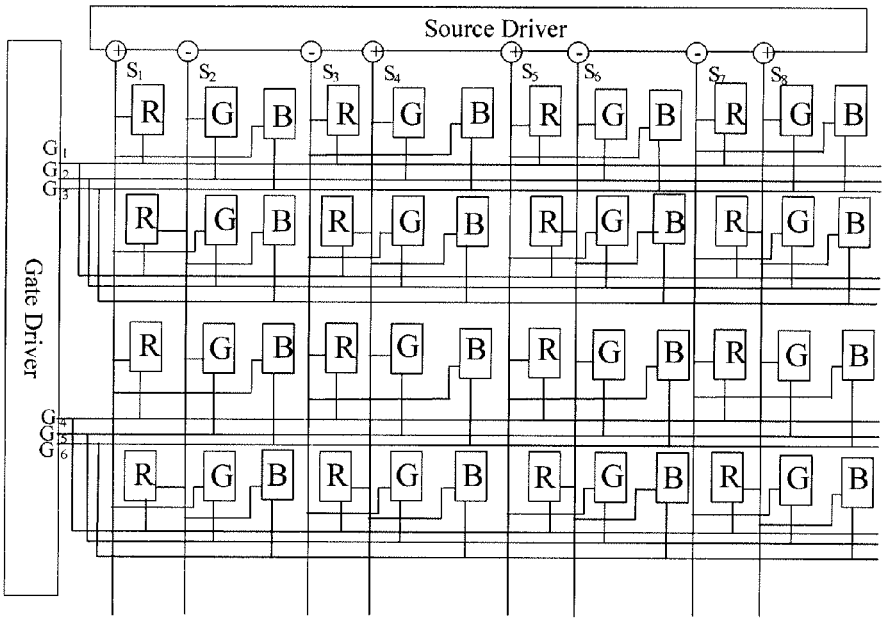
FIG. 6 is a second schematic diagram of a sub-pixel array where adopting red green and blue three primary colors in the present invention.

As illustrated in FIG. 6, in this embodiment, taking a liquid crystal display of three primary colors RGB and with a resolution of n*m as an example, that is, m equals to 3, The RGB sub-pixels of a same pixel are arranged horizontally. There are totally 1.5n scan lines and 2m data lines.

For the sub-pixels of the $i^{th}$ and the $i+1^{th}$ rows, the $3j+1^{th}$ column of sub-pixels are connected with the $(3i-1)/2^{th}$ scan line G ((3i−1)/2), the $3j+2^{th}$ column of sub-pixels are connected with the $(3i+1)/2^{th}$ scan line G ((3i+1)/2), and the $3j+3^{th}$ column of sub-pixels are connected with the $(3i+3)/2^{th}$ scan line G ((3i+3)/2); wherein i is an odd number greater than or equal to 1 and less than or equal to n−1, and j is an integer greater than or equal to 0 and less than or equal to m−1. At the same time, the $2k-1^{th}$ data line S(2k−1) is connected with the sub-pixels of the $3k-2^{th}$ and the $3k^{th}$ columns of the odd numbered rows of sub-pixels and the sub-pixels of the $3k-1^{th}$ column of the even numbered rows of sub-pixels in the sub-pixel matrix; and the $2k^{th}$ data line S(2k) is connected with the sub-pixels of the $3k-1^{th}$ columns of the odd numbered rows of sub-pixels, and the sub-pixels of the $3k-2^{th}$ and the $3k^{th}$ columns of the even numbered rows of sub-pixels in the sub-pixel matrix, wherein k is an integer greater than or equal to 1 and less than or equal to m. FIG. 6 is only a partial schematic diagram of the pixel matrix showing 6 scan lines and 8 data lines, however the scope of the present embodiment is not limited thereto.

The implementation of a frame of picture includes the following process.

When G1 is turned on, the sub-pixel data for the $1^{st}$ and $2^{nd}$ rows are written into corresponding sub-pixels through respective data lines. For example, the red sub-pixel data $R_{1,1}$ of $1^{st}$ row, $1^{st}$ column are output over S1, the red sub-pixel data $R_{2,1}$ of $2^{nd}$ row, $1^{st}$ column are output over S2, . . . , the red sub-pixel data $R_{1,m}$ of $1^{st}$ row, $m^{th}$ column are output over S(2m−1), and the red sub-pixel data $R_{2,n}$, of $2^{nd}$ row, $m^{th}$ column are output over S(2m).

When G2 is turned on, the sub-pixel data for the $1^{st}$ and $2^{nd}$ rows are written into corresponding sub-pixels through respective data lines. For example, the green sub-pixel data $G_{2,1}$ of $2^{st}$ row, $1^{st}$ column are output over S1, the green sub-pixel data $G_{1,1}$ of $1^{st}$ row, $1^{st}$ column are output over S2, . . . , the green sub-pixel data $G_{2,n}$, of $2^{nd}$ row, $m^{th}$ column are output over S(2m−1), and the green sub-pixel data $G_{1,m}$ of $1^{st}$ row, $m^{th}$ column are output over S(2m).

When G3 is turned on, the sub-pixel data for the $1^{st}$ and $2^{nd}$ rows are written into corresponding sub-pixels through respective data lines. For example, the blue sub-pixel data $B_{1,1}$ of $1^{st}$ row, $1^{st}$ column are output over S1, the blue sub-pixel data $B_{2,1}$ of $2^{nd}$ row, $1^{st}$ column are output over S2, . . . , the blue sub-pixel data $B_{1,m}$ of $1^{st}$ row, $m^{th}$ column are output over S(2m−1), and the blue sub-pixel data $B_{2,m}$ of $2^{nd}$ row, $m^{th}$ column are output over S(2m).

. . .

When G(1.5n−2) is turned on, the sub-pixel data for the $n-1^{th}$ and $n^{th}$ rows are written into corresponding sub-pixels through respective data lines. For example, the red sub-pixel data $R_{n-1,1}$ of $n-1^{th}$ row, $1^{st}$ column are output over S1, the red sub-pixel data $R_{n,1}$ of $n^{th}$ row, $1^{st}$ column are output over S2, . . . , the red sub-pixel data $R_{n-1,m}$ of $n-1^{th}$ row, $m^{th}$ column are output over S(2m−1), and the red sub-pixel data $R_{n,m}$ of $n^{th}$ row, $m^{th}$ column are output over S(2m).

When G(1.5n−1) is turned on, the sub-pixel data for the $n-1^{th}$ and $n^{th}$ rows are written into corresponding sub-pixels through respective data lines. For example, the green sub-pixel data $G_{n,1}$ of $n^{th}$ row, $1^{st}$ column are output over S1, the green sub-pixel data $G_{n-1,1}$ of $n-1^{th}$ row, $1^{st}$ column are output over S2, . . . , the green sub-pixel data $G_{n,m}$ of $n^{th}$ row, $m^{th}$ column are output over S(2m−1), and the green sub-pixel data of $n-1^{th}$ row, $m^{th}$ column are output over S(2m).

When G(1.5n) is turned on, the sub-pixel data for the $n-1^{th}$ and $n^{th}$ rows are written into corresponding sub-pixels through respective data lines. For example, the blue sub-pixel data $B_{n-1,1}$ of $n-1^{th}$ row, $1^{st}$ column are output over S1, the blue sub-pixel data $B_{n,1}$ of $n^{th}$ row, $1^{st}$ column are output over S2, . . . , the blue sub-pixel data of $B_{n-1,m}$ of n−1$^{th}$ row, m$^{th}$ column are output over S(2m−1), and the blue sub-pixel data $B_{n,m}$ of n$^{th}$ row, m$^{th}$ column are output over S(2m).

As can be seen from the above-described process, in a frame of picture, when the timing control circuit controls the 1$^{st}$ scan line in every 3 adjacent scan lines to turn on, an odd numbered column of data lines writes data into the 1$^{st}$ sub-pixel in the every 3 adjacent sub-pixels in an odd numbered row of sub-pixels connected with the 1$^{st}$ scan line, an even numbered column of data lines writes data into the 1$^{st}$ sub-pixel in the every 3 adjacent sub-pixels in an even numbered row of sub-pixels connected with the 1st scan line. As can be seen in FIG. 6, all R sub-pixels in the two rows of sub-pixels adjacent to the turned-on scan line from above and below are written with data.

When the timing control circuit controls the 2$^{nd}$ scan line in the every 3 adjacent scan lines to turn on, the odd numbered column of data lines writes data into the 2$^{nd}$ sub-pixel in the every 3 adjacent sub-pixels in the odd numbered row of sub-pixels connected with the 2nd scan line, the even numbered column of data lines writes data into the 2$^{nd}$ sub-pixel in the every 3 adjacent sub-pixels in the even numbered row of sub-pixels connected with the 2nd scan line. As can be seen in FIG. 6, all G sub-pixels in the two rows of sub-pixels adjacent to the turned-on scan line from above and below are written with data.

When the timing control circuit controls the 3$^{rd}$ scan line in every 3 adjacent scan lines to turn on, the odd numbered column of data lines writes data into the 3$^{rd}$ sub-pixel in the every 3 adjacent sub-pixels in the odd numbered row of sub-pixels connected with the 3$^{rd}$ scan line, the even numbered column of data lines writes data into the 3$^{rd}$ sub-pixel in the every 3 adjacent sub-pixels in the even numbered row of sub-pixels connected with the 3rd scan line. As can be seen in FIG. 6, all B sub-pixels in the two rows of sub-pixels adjacent to the turned-on scan line from above and below are written with data.

Data writing modes in embodiments IV and VI are the same as embodiment II.

It is assumed that the frame frequency is 60 Hz, charging time for each pixel unit of the dual-gate driven liquid crystal display device is 1/(60*2n)s, and charging time for each pixel unit of the triple-gate driven liquid crystal display device is 1/(60*3n)s. While in this example, the charging time for each pixel unit of the liquid crystal display device is 1/(60*1.5n)s.

Figure 7:
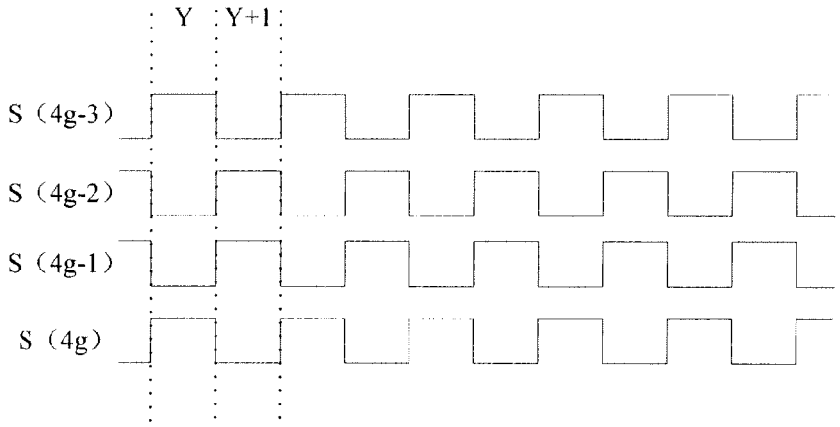
FIG. 7 is a schematic diagram of pixel polarity reversal on data lines for different frames of pictures where adopting red green and blue three primary colors in the present invention.
Figure 8:
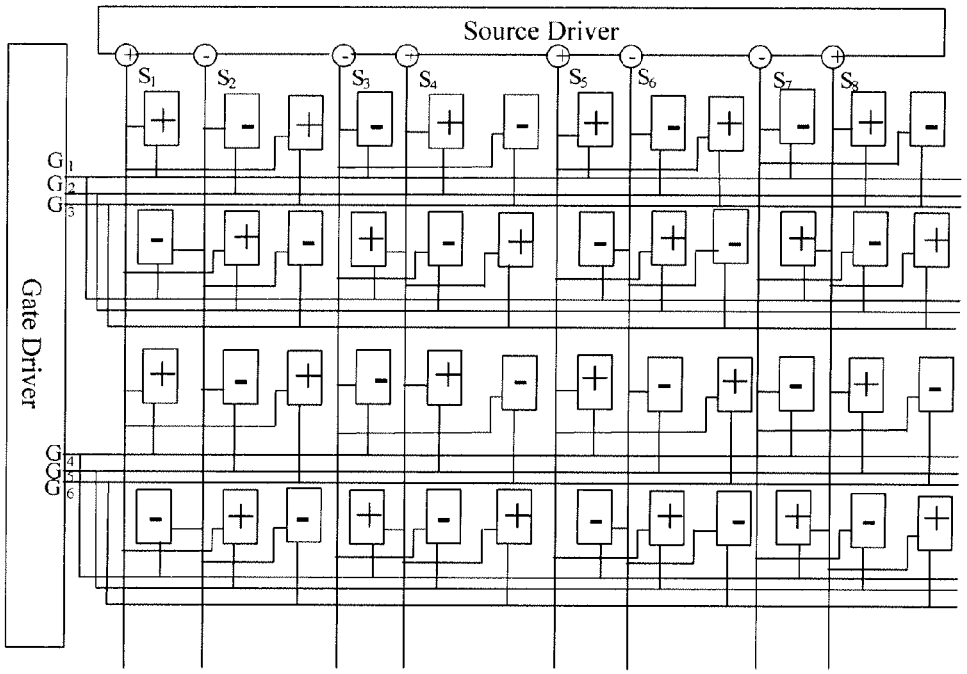
FIGS. 8 and 9 are schematic diagrams of pixel polarity reversal for different frames of pictures where adopting red green and blue three primary colors in the present invention.
Figure 9:
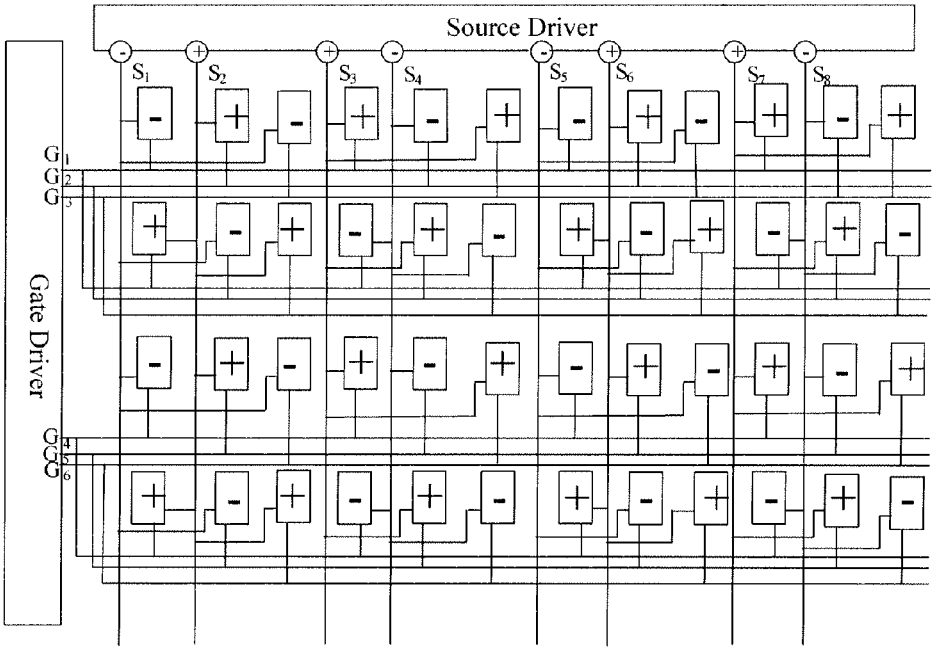

As illustrated in FIGS. 7 to 9, in order to realize the dot inversion for the entire picture, in a same frame of picture, pixels on a same data line have a same polarity, pixels on the 4g−3$^{th}$ and the 4g−2$^{th}$ data lines have opposite polarities to each other, pixels on the 4g−1$^{th}$ and the 4g$^{th}$ data lines have opposite polarities to each other, pixels on the 4g−3$^{th}$, 4g−2$^{th}$, 4g−1$^{th}$ and 4g$^{th}$ data lines have polarities of "positive, negative, negative, positive" ("+−−+") or "negative, positive, positive, negative" ("−++−"), wherein g is an integer greater than or equal to 1 and less than or equal to m/2. For different frames of pictures, pixels on the same data lines have opposite polarities.

Embodiment III

Figure 10:
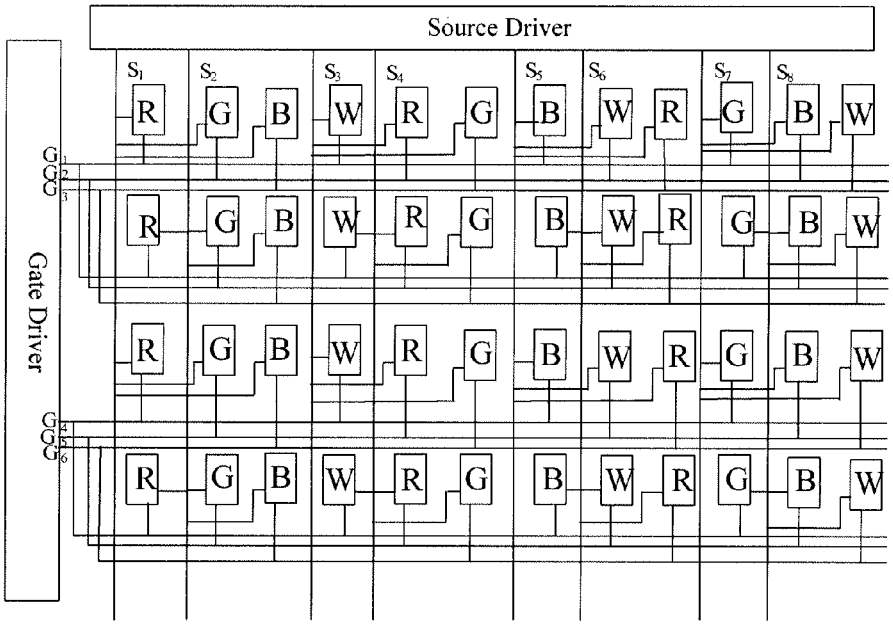
FIG. 10 is a first schematic diagram of a sub-pixel array where adopting red, green, blue and yellow four primary colors in the present invention.

As illustrated in FIG. 10, in this embodiment, taking a liquid crystal display of four primary colors RGBW and with a resolution n*m as an example, that is, m equals to 4, the RGBW sub-pixels of a same pixel are arranged horizontally. There are totally 1.5n scan lines and 8m/3 data lines.

For the sub-pixels of the i$^{th}$ and the i+1$^{th}$ rows, the 3j+1$^{th}$ column of sub-pixels are connected with the (3i−1)/2$^{th}$ scan line G ((3i−1)/2), the 3j+2$^{th}$ column of sub-pixels are connected with the (3i+1)/2$^{th}$ scan line G ((3i+1)/2), and the 3j+3$^{th}$ column of sub-pixels are connected with the (3i+3)/2$^{th}$ scan line G ((3i+3)/2); wherein i is an odd number greater than or equal to 1 and less than or equal to n−1, and j is an integer greater than or equal to 0 and less than or equal to m−1. At the same time, the 2k−1$^{th}$ data line S(2k−1) is connected with the sub-pixels of the 3k−2$^{th}$, 3k−1$^{th}$ and 3k$^{th}$ columns of the odd numbered rows of sub-pixels in the sub-pixel matrix; the 2k$^{th}$ data line S(2k) is connected with the sub-pixels of the 3k−2$^{th}$, 3k−1$^{th}$ and 3k$^{th}$ columns of the even numbered rows of sub-pixels in the sub-pixel matrix, wherein k is an integer greater than or equal to 1 and less than or equal to 4m/3. FIG. 10 is only a partial schematic diagram of the pixel matrix showing 6 scan lines and 8 data lines, however the scope of the present embodiment is not limited thereto.

The implementation of a frame of picture includes the following process.

When G1 is turned on, the sub-pixel data for the 1$^{st}$ and 2$^{nd}$ rows are written into corresponding sub-pixels through respective data lines. For example, the red sub-pixel data $R_{1,1}$ of 1$^{st}$ row, 1$^{st}$ column are output over S1, the red sub-pixel data $R_{2,1}$ of 2$^{nd}$ row, 1$^{st}$ column are output over S2, . . . , the green sub-pixel data $G_{1,m}$ of 1$^{st}$ row, m$^{th}$ column are output over S(8m/3−1), and the green sub-pixel data $G_{2,m}$ of 2$^{nd}$ row, m$^{th}$ column are output over S(8m/3).

When G2 is turned on, the sub-pixel data for the 1$^{st}$ and 2$^{nd}$ rows are written into corresponding sub-pixels through respective data lines. For example, the green sub-pixel data $G_{1,1}$ of 1$^{st}$ row, 1$^{st}$ column are output over S1, the green sub-pixel data $G_{2,1}$ of 2$^{nd}$ row, 1$^{st}$ column are output over S2, . . . , the blue sub-pixel data $B_{1,m}$ of 1$^{st}$ row, m$^{th}$ column are output over S(8m/3−1), and the blue sub-pixel data $B_{2,m}$ of 2$^{nd}$ row, m$^{th}$ column are output over S(8m/3).

When G3 is turned on, the sub-pixel data for the 1$^{st}$ and 2$^{nd}$ rows are written into corresponding sub-pixels through respective data lines. For example, the blue sub-pixel data $B_{1,1}$ of 1$^{st}$ row, 1$^{st}$ column are output over S1, the blue sub-pixel data $B_{2,1}$ of 2$^{nd}$ row, 1$^{st}$ column are output over S2, . . . , the white sub-pixel data $W_{1,m}$ of 1$^{st}$ row, m$^{th}$ column are output over S(8m/3−1), and the white sub-pixel data $W_{2,m}$ of 2$^{nd}$ row, m$^{th}$ column are output over S(8m/3).

. . .

When G(1.5n−2) is turned on, the sub-pixel data for the n−1$^{th}$ and n$^{th}$ rows are written into corresponding sub-pixels through respective data lines. For example, the red sub-pixel data $R_{n-1,1}$ of n−1$^{th}$ row, 1$^{st}$ column are output over S1, the red sub-pixel data $R_{n,1}$ of n$^{th}$ row, 1$^{st}$ column are output over S2, . . . , the green sub-pixel data $G_{n-1,1}$ of n−1$^{th}$ row, m$^{th}$ column are output over S(8m/3−1), and the green sub-pixel data $G_{n,m}$ of n$^{th}$ row, m$^{th}$ column are output over S(8m/3).

When G(1.5n−1) is turned on, the sub-pixel data for the n−1$^{th}$ and n$^{th}$ rows are written into corresponding sub-pixels through respective data lines. For example, the green sub-pixel data $G_{n-1,1}$ of n−1$^{th}$ row, 1$^{st}$ column are output over S1, the green sub-pixel data $G_{n,1}$ of n$^{th}$ row, 1$^{st}$ column are output over S2, . . . , the blue sub-pixel data $B_{n-1,m}$ of n−1$^{th}$ row, m$^{th}$ column are output over S(8m/3−1), and the blue sub-pixel data $B_{n,m}$ of n$^{th}$ row, m$^{th}$ column are output over S(8m/3).

When G(1.5n) is turned on, the sub-pixel data for the n−1$^{th}$ and n$^{th}$ rows are written into corresponding sub-pixels through respective data lines. For example, the blue sub-pixel data $B_{n-1,1}$ of n−1$^{th}$ row, 1$^{st}$ column are output over S1, the blue sub-pixel data $B_{n,1}$ of n$^{th}$ row, 1$^{st}$ column are output over S2, . . . , the white sub-pixel data $W_{n-1,m}$ of n−1$^{th}$ row, m$^{th}$ column are output over S(8m/3−1), and the white sub-pixel data $W_{n,m}$ of n$^{th}$ row, m$^{th}$ column are output over S(8m/3).

It is assumed that the frame frequency is 60 Hz, charging time for each pixel unit of the dual-gate driven liquid crystal display device is 1/(60*2n)s, and charging time for each pixel unit of the triple-gate driven liquid crystal display device is 1/(60*3n)s. While in this example, the charging time for each pixel unit of the liquid crystal display device is 1/(60*1.5n)s.

Figure 11:
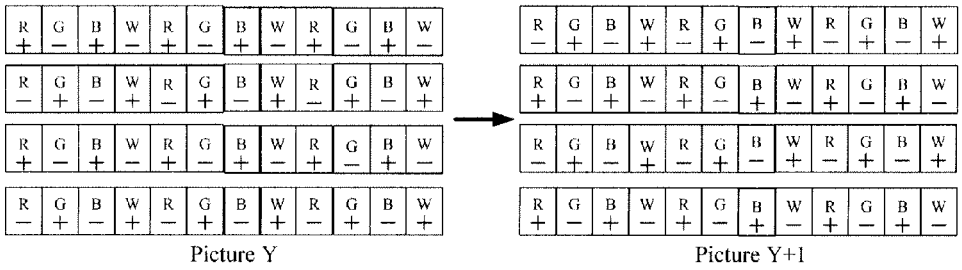
FIG. 11 is a comparison schematic diagram of pixel polarity reversal for two adjacent frames of pictures where adopting red, green, blue and yellow four primary colors in the present invention.

In order to decrease twinkling, as illustrated in FIG. 11, the inversion mode of the entire picture is dot inversion. As to the liquid crystal display panel as illustrated in FIG. 10, if dot inversion is adopted, the data line needs to be inversed for several times for displaying one frame of picture, with the polarity inversion diagram as illustrated in FIGS. 4 and 5. FIGS. 4 and 5 illustrate a polarity inversion diagram for three primary colors. Embodiment III represents a polarity inversion diagram for four primary colors. However, after removing sub-pixel labels, the polarity inversion diagram of embodiment I is the same with embodiment III. The "+" and "−" labeled on pixels denote the polarity of the pixel. When G1 is turned on, in order to charge the red sub-pixel of $1^{st}$ row, $1^{st}$ column in the pixel group, the polarity on S1 is positive. When G2 is turned on, in order to charge the green sub-pixel of $1^{st}$ row, $1^{st}$ column in the pixel group, the polarity on S1 is negative. When G3 is turned on, in order to charge the blue sub-pixel of $1^{st}$ row, $1^{st}$ column in the pixel group, the polarity on S1 is positive. Frequent polarity inversion on the data lines consumes a large amount of energy and the consumed energy is converted into heat to heat the driving circuits, which is disadvantageous for the life of liquid crystal display. The following embodiment IV can solve this problem.

Embodiment IV

Figure 12:
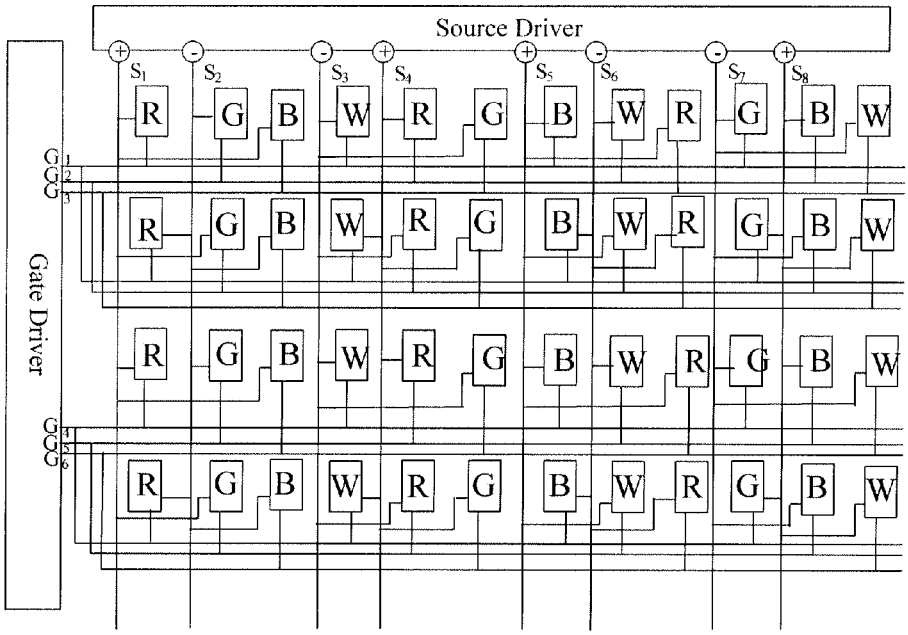
FIG. 12 is a second schematic diagram of a sub-pixel array where adopting red, green, blue and yellow four primary colors in the present invention.

As illustrated in FIG. 12, in this embodiment, taking a liquid crystal display of four primary colors RGBW and with a resolution n*m as an example, that is, m equals to 4, RGBW sub-pixels of a same pixel are arranged horizontally. There are totally 1.5n scan lines and 8m/3 data lines.

For the sub-pixels of the $i^{th}$ and the $i+1^{th}$ rows, the $3j+1^{th}$ column of sub-pixels are connected with the $(3i-1)/2^{th}$ scan line G ((3i−1)/2), the $3j+2^{th}$ column of sub-pixels are connected with the $(3i+1)/2^{th}$ scan line G ((3i+1)/2), and the $3j+3^{th}$ column of sub-pixels are connected with the $(3i+3)/2^{th}$ scan line G ((3i+3)/2); wherein i is an odd number greater than or equal to 1 and less than or equal to n−1, and j is an integer greater than or equal to 0 and less than or equal to m−1. At the same time, the $2k-1^{th}$ data line S(2k−1) is connected with the sub-pixels of the $3k-2^{th}$ and $3k^{th}$ columns of the odd numbered rows of sub-pixels and the sub-pixels of the $3k-1^{th}$ column of the even numbered rows of sub-pixels in the sub-pixel matrix; The 2kth data line S(2k) is connected with the sub-pixels of the $3k-1^{th}$ columns of the odd numbered rows of sub-pixels, and the sub-pixels of the $3k-2^{th}$ and the $3k^{th}$ columns of the even numbered rows of sub-pixels in the sub-pixel matrix, wherein k is an integer greater than or equal to 1 and less than or equal to 4m/3. FIG. 12 is only a partial schematic diagram of the pixel matrix showing 6 scan lines and 8 data lines, however the scope of the present embodiment is not limited thereto.

The implementation of a frame of picture includes the following process.

When G1 is turned on, the sub-pixel data for the $1^{st}$ and $2^{nd}$ rows are written into corresponding sub-pixels through respective data lines. For example, the red sub-pixel data $R_{1,1}$ of $1^{st}$ row, $1^{st}$ column are output over S1, the red sub-pixel data $R_{2,1}$ of $2^{nd}$ row, $1^{st}$ column are output over S2, . . . , the green sub-pixel data $G_{1,m}$ of $1^{st}$ row, $m^{th}$ column are output over S(8m/3−1), and the green sub-pixel data $G_{2,m}$ of $2^{nd}$ row, $m^{th}$ column are output over S(8m/3).

When G2 is turned on, the sub-pixel data for the $1^{st}$ and $2^{nd}$ rows are written into corresponding sub-pixels through respective data lines. For example, the green sub-pixel data $G_{2,1}$ of $2^{nt}$ row, $1^{st}$ column are output over S1, the green sub-pixel data $G_{1,1}$ of $1^{st}$ row, $1^{st}$ column are output over S2, . . . , the blue sub-pixel data $B_{2,m}$ of $2^{nd}$ row, $m^{th}$ column are output over S(8m/0.3−1), and the blue sub-pixel data $B_{1,m}$ of $1^{st}$ row, $m^{th}$ column are output over S(8m/3).

When G3 is turned on, the sub-pixel data for the $1^{st}$ and $2^{nd}$ rows are written into corresponding sub-pixels through respective data lines. For example, the blue sub-pixel data $B_{1,1}$ of $1^{st}$ row, $1^{st}$ column are output over S1, the blue sub-pixel data $B_{2,1}$ of $2^{nd}$ row, $1^{st}$ column are output over S2, . . . , the white sub-pixel data $W_{1,m}$ of $1^{st}$ row, $m^{th}$ column are output over S(8m/3−1), and the white sub-pixel data $W_{2,m}$ of $2^{nd}$ row, $m^{th}$ column are output over S(8m/3).

. . .

When G(1.5n−2) is turned on, the sub-pixel data for the $n-1^{th}$ and $n^{th}$ rows are written into corresponding sub-pixels through respective data lines. For example, the red sub-pixel data $R_{n-1,1}$ of $n-1^{th}$ row, $1^{st}$ column are output over S1, the red sub-pixel data $R_{n,1}$ of $n^{th}$ row, $1^{st}$ column are output over S2, . . . , the green sub-pixel data $G_{n-1,m}$ of $n-1^{th}$ row, $m^{th}$ column are output over S(8m/3−1), and the green sub-pixel data $G_{n,m}$ of $n^{th}$ row, $m^{th}$ column are output over S(8m/3).

When G(1.5n−1) is turned on, the sub-pixel data for the $n-1^{th}$ and $n^{th}$ rows are written into corresponding sub-pixels through respective data lines. For example, the green sub-pixel data $G_{n,1}$ of $n^{th}$ row, $1^{st}$ column are output over S1, the green sub-pixel data $G_{n-1,1}$ of $n-1^{th}$ row, $1^{st}$ column are output over S2, . . . , the blue sub-pixel data $B_{n,m}$ of $n^{th}$ row, $m^{th}$ column are output over S(8m/3−1), and the blue sub-pixel data $B_{n-1,m}$ of $n-1^{th}$ row, $m^{th}$ column are output over S(8m/3).

When G(1.5n) is turned on, the sub-pixel data for the $n-1^{th}$ and $n^{th}$ rows are written into corresponding sub-pixels through respective data lines. For example, the blue sub-pixel data $B_{n-1,1}$ of $n-1^{th}$ row, $1^{st}$ column are output over S1, the blue sub-pixel data $B_{n,1}$ of $n^{th}$ row, $1^{st}$ column are output over S2, . . . , the white sub-pixel data $W_{n-1,m}$ of $n-1^{th}$ row, $m^{th}$ column are output over S(8m/3−1), and the white sub-pixel data $W_{n,m}$ of $n^{th}$ row, $m^{th}$ column are output over S(8m/3).

It is assumed that the frame frequency is 60 Hz, charging time for each pixel unit of the dual-gate driven liquid crystal display device is 1/(60*2n)s, and charging time for each pixel unit of the triple-gate driven liquid crystal display device is 1/(60*3n)s. While in this example, the charging time for each pixel unit of the liquid crystal display device is 1/(60*1.5n)s.

The polarity inversion diagram is illustrated in FIGS. 7 to 9. Here, although FIGS. 7 to 9 show a polarity inversion diagram for three primary colors, and embodiment IV represents a polarity inversion diagram for four primary colors. However, after removing sub-pixel labels, the polarity inversion diagram of embodiment II is the same with embodiment IV.

In order to realize the dot inversion for the entire picture, in the same frame of picture, pixels on a same data line have a same polarity, pixels on the $4g-3^{th}$ and the $4g-2^{th}$ data lines have opposite polarities to each other, pixels on the $4g-1^{th}$ and the $4g^{th}$ data lines have opposite polarities to each other, pixels on the $4g-3^{th}$, $4g-2^{th}$, $4g-1^{th}$ and $4g^{th}$ data lines have polarities of "positive, negative, negative, positive" ("+−−+") or "negative, positive, positive, negative" ("−++−"), wherein g is an integer greater than or equal to 1 and less than or equal to 2m/3. For different frames of pictures, pixels on the same data lines have opposite polarities.

Embodiment V

Figure 13:
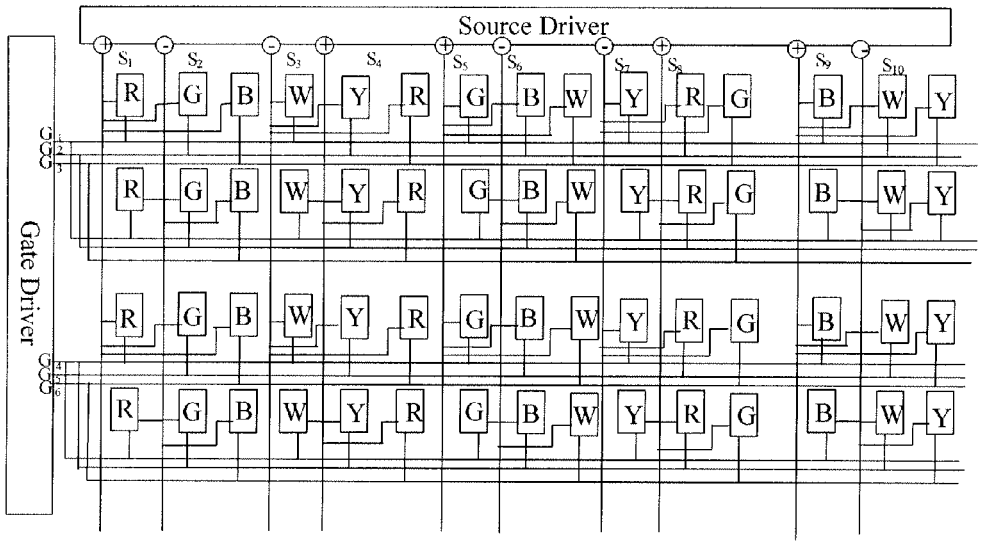
FIG. 13 is a first schematic diagram of a sub-pixel array where adopting red, green, blue, yellow and white five primary colors in the present invention.

As illustrated in FIG. 13, in this embodiment, taking a liquid crystal display of five primary colors RGBWY and with a resolution n*m as an example, that is, m equals to 5, the RGBWY sub-pixels of a same pixel are arranged horizontally. There are totally 1.5n scan lines and 10m/3 data lines.

For the sub-pixels of the $i^{th}$ and the $i+1^{th}$ rows, the $3j+1^{th}$ column of sub-pixels are connected with the $(3i-1)/2^{th}$ scan line G ((3i−1)/2), the $3j+2^{th}$ column of sub-pixels are connected with the $(3i+1)/2^{th}$ scan line G ((3i+1)/2), and the $3j+3^{th}$ column of sub-pixels are connected with the $(3i+3)/2^{th}$ scan line G ((3i+3)/2); wherein i is an odd number greater than or equal to 1 and less than or equal to n−1, and j is an integer greater than or equal to 0 and less than or equal to (5m/3)−1. At the same time, the $2k-1^{th}$ data line S(2k−1) is connected with the sub-pixels of the $3k-2^{th}$, $3k-1^{th}$ and $3k^{th}$ columns of the odd numbered rows of sub-pixels in the sub-pixel matrix; the $2k^{th}$ data line S(2k) is connected with the sub-pixels of the $3k-2^{th}$, $3k-1^{th}$ and $3k^{th}$ columns of the even numbered rows of sub-pixels in the sub-pixel matrix, wherein k is an integer greater than or equal to 1 and less than or equal to 5m/3. FIG. 13 is only a partial schematic diagram of the pixel matrix showing 6 scan lines and 10 data lines, however the scope of the present embodiment is not limited thereto.

The implementation of a frame of picture includes the following process.

When G1 is turned on, the sub-pixel data for the $1^{st}$ and $2^{nd}$ rows are written into corresponding sub-pixels through respective data lines. For example, the red sub-pixel data $R_{1,1}$ of $1^{st}$ row, $1^{st}$ column are output over S1, the red sub-pixel data $R_{2,1}$ of $2^{nd}$ row, $1^{st}$ column are output over S2, . . . , the blue sub-pixel data $B_{1,n}$ of $1^{st}$ row, $m^{th}$ column are output over S(10m/3−1), and the blue sub-pixel data $B_{2,m}$ of $2^{nd}$ row, $m^{th}$ column are output over S(10m/3).

When G2 is turned on, the sub-pixel data for the $1^{st}$ and $2^{nd}$ rows are written into corresponding sub-pixels through respective data lines. For example, the green sub-pixel data $G_{1,1}$ of $1^{st}$ row, $1^{st}$ column are output over S1, the green sub-pixel data $G_{2,1}$ of $2^{nd}$ row, $1^{st}$ column are output over S2, . . . , the white sub-pixel data $W_{1,n}$, of $1^{st}$ row, $m^{th}$ column are output over S(10m/3−1), and the white sub-pixel data $W_{2,m}$ of $2^{nd}$ row, $m^{th}$ column are output over S(10m/3).

When G3 is turned on, the sub-pixel data for the $1^{st}$ and $2^{nd}$ rows are written into corresponding sub-pixels through respective data lines. For example, the blue sub-pixel data $B_{1,1}$ of $1^{st}$ row, $1^{st}$ column are output over S1, the blue sub-pixel data $B_{2,1}$ of $2^{nd}$ row, $1^{st}$ column are output over S2, . . . , the yellow sub-pixel data $Y_{1,m}$ of $1^{st}$ row, $m^{th}$ column are output over S(10m/3−1), and the yellow sub-pixel data $Y_{2,m}$ of $2^{nd}$ row, $m^{th}$ column are output over S(10m/3).

. . .

When G(1.5n−2) is turned on, the sub-pixel data for the $n-1^{th}$ and $n^{th}$ rows are written into corresponding sub-pixels through respective data lines. For example, the red sub-pixel data $R_{n-1,1}$ of $n-1^{th}$ row, $1^{st}$ column are output over S1, the red sub-pixel data $R_{n,1}$ of $n^{th}$ row, $1^{st}$ column are output over S2, . . . , the blue sub-pixel data $B_{n-1,m}$ of $n-1^{th}$ row, $m^{th}$ column are output over S(10m/3−1), and the blue sub-pixel data $B_{n,m}$ of $n^{th}$ row, $m^{th}$ column are output over S(10m/3).

When G(1.5n−1) is turned on, the sub-pixel data for the $n-1^{th}$ and $n^{th}$ rows are written into corresponding sub-pixels through respective data lines. For example, the green sub-pixel data $G_{n-1,1}$ of $n-1^{th}$ row, $1^{st}$ column are output over S1, the green sub-pixel data $G_{n,1}$ of $n^{th}$ row, $1^{st}$ column are output over S2, . . . , the white sub-pixel data $W_{n-1,m}$ of $n-1^{th}$ row, $m^{th}$ column are output over S(10m/3−1), and the white sub-pixel data $W_{n,m}$ of $n^{th}$ row, $m^{th}$ column are output over S(10m/3).

When G(1.5n) is turned on, the sub-pixel data for the $n-1^{th}$ and $n^{th}$ rows are written into corresponding sub-pixels through respective data lines. For example, the blue sub-pixel data $B_{n-1,1}$ of $n-1^{th}$ row, $1^{st}$ column are output over S1, the blue sub-pixel data $B_{n,1}$ of $n^{th}$ row, $1^{st}$ column are output over S2, . . . , the yellow sub-pixel data $Y_{n-1,m}$ of $n-1^{th}$ row, $m^{th}$ column are output over S(10m/3−1), and the yellow sub-pixel data $Y_{n,m}$ of $n^{th}$ row, $m^{th}$ column are output over S(10m/3).

It is assumed that the frame frequency is 60 Hz, charging time for each pixel unit of the dual-gate driven liquid crystal display device is 1/(60*2n)s, and charging time for each pixel unit of the triple-gate driven liquid crystal display device is 1/(60*3n)s. While in this example, the charging time for each pixel unit of the liquid crystal display device is 1/(60*1.5n)s.

Figure 14:
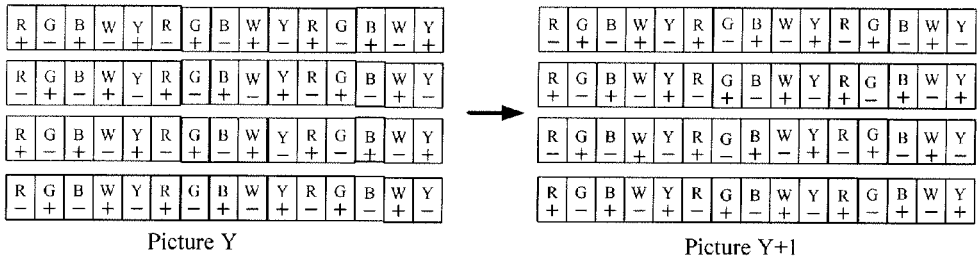
FIG. 14 is a comparison schematic diagram of pixel polarity reversal for two adjacent frames of pictures where adopting red, green, blue, yellow and white five primary colors in the present invention.
Figure 15:
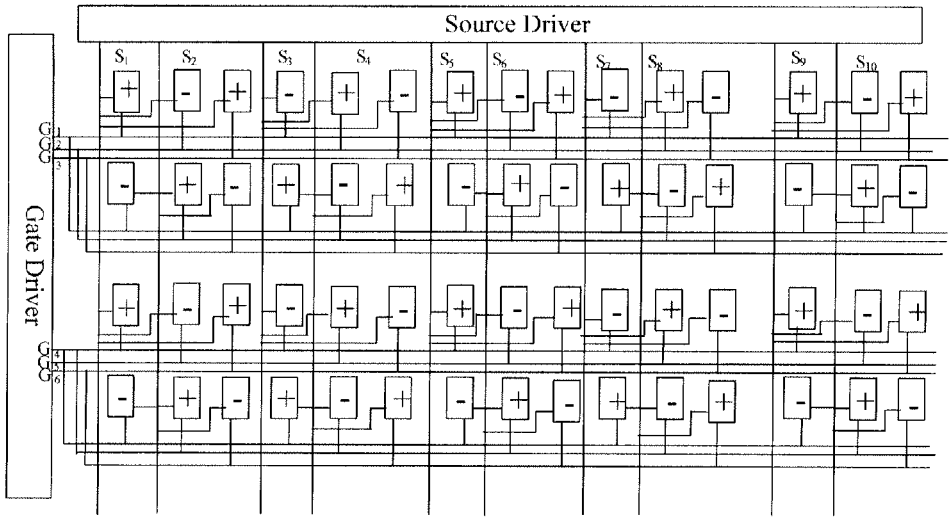
FIGS. 15 and 16 are a pixel array schematic diagrams of pixel polarity reversal for two adjacent frames of pictures where adopting red, green, blue, yellow and white five primary colors in the present invention.
Figure 16:
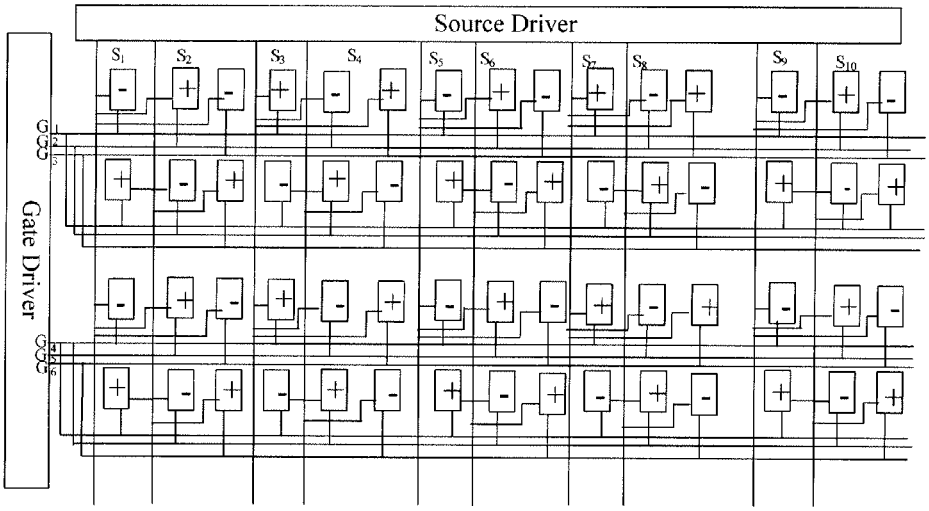

In order to decrease twinkling, as illustrated in FIG. 14, the inversion mode for the entire picture is dot inversion. As to the liquid crystal display panel as illustrated in FIG. 13, if dot inversion is adopted, the data line needs to be inversed for several times for displaying one frame of picture, as illustrated in FIGS. 15 and 16. The "+" and "−" labeled on pixels denote polarities of the pixels. When G1 is turned on, in order to charge the red sub-pixel of $1^{st}$ row, $1^{st}$ column in the pixel group, the polarity on S1 is positive. When G2 is turned on, in order to charge the green sub-pixel of $1^{st}$ row, $1^{st}$ column in the pixel group, the polarity on S1 is negative. When G3 is turned on, in order to charge the blue sub-pixel of $1^{st}$ row, $1^{st}$ column in the pixel group, the polarity on S1 is positive. Frequent polarity inversion on the data lines consumes a large amount of energy and the consumed energy is converted into heat to heat the driving circuits, which is disadvantageous for the life of liquid crystal display. The following embodiment VI can solve this problem.

Embodiment VI

Figure 17:
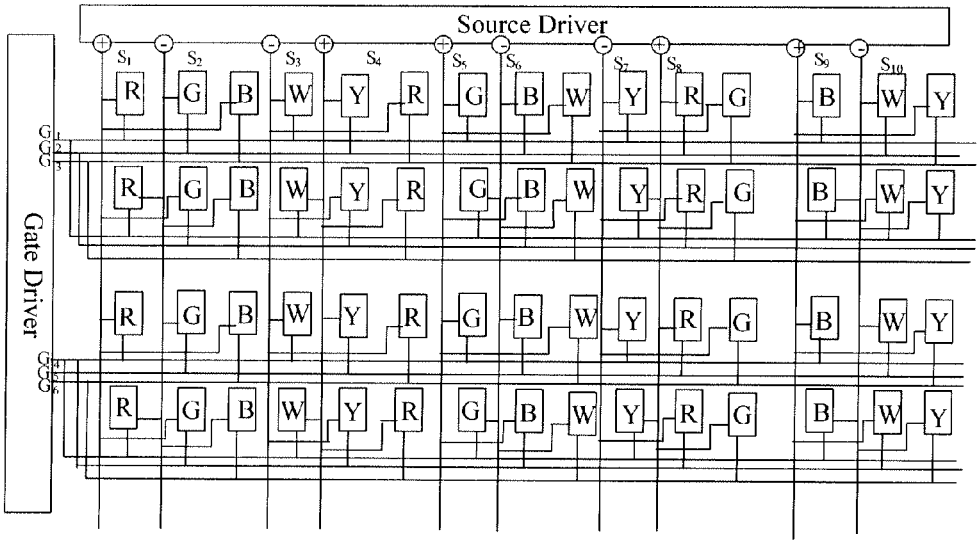
FIG. 17 is a second schematic diagram of a sub-pixel array where adopting red, green, blue, yellow and white five primary colors in the present invention.

As illustrated in FIG. 17, in this embodiment, taking a liquid crystal display of five primary colors RGBWY and with a resolution n*m as an example, that is, m equals to 5, the RGBWY sub-pixels of a same pixel are arranged horizontally. There are totally 1.5n scan lines and 10m/3 data lines.

For the sub-pixels of the $i^{th}$ and the $i+1^{th}$ rows, the $3j+1^{th}$ column of sub-pixels are connected with the $(3i-1)/2^{th}$ scan line G ((3i−1)/2), the $3j+2^{th}$ column of sub-pixels are connected with the $(3i+1)/2^{th}$ scan line G ((3i+1)/2), and the $3j+3^{th}$ column of sub-pixels are connected with the $(3i+3)/2^{th}$ scan line G ((3i+3)/2); wherein i is an odd number greater than or equal to 1 and less than or equal to n−1, and j is an integer greater than or equal to 0 and less than or equal to (5m/3)−1. At the same time, the $2k-1^{th}$ data line S(2k−1) is connected with the sub-pixels of the $3k-2^{th}$ and $3k^{th}$ columns of the odd numbered rows of sub-pixels and the sub-pixels of the $3k-1^{th}$ column of the even numbered rows of sub-pixels in the sub-pixel matrix; the $2k^{th}$ data line S(2k) is connected with the sub-pixels of the $3k-1^{th}$ columns of the odd numbered rows of sub-pixels, and the sub-pixels of the $3k-2^{th}$ and the $3k^{th}$ columns of the even numbered rows of sub-pixels in the sub-pixel matrix, wherein k is an integer greater than or equal to 1 and less than or equal to 5m/3. FIG. 17 is only a partial schematic diagram of the pixel matrix showing 6 scan lines and 10 data lines, however the scope of the present embodiment is not limited thereto.

The implementation of a frame of picture includes the following process.

When G1 is turned on, the sub-pixel data for the $1^{st}$ and $2^{nd}$ rows are written into corresponding sub-pixels through respective data lines. For example, the red sub-pixel data $R_{1,1}$ of $1^{st}$ row, $1^{st}$ column are output over S1, the red sub-pixel data $R_{2,1}$ of $2^{nd}$ row, $1^{st}$ column are output over S2, . . . , the blue sub-pixel data $G_{1,m}$ of $1^{st}$ row, $m^{th}$ column are output over S(10m/3−1), and the blue sub-pixel data $B_{,m}$ of $2^{nd}$ row, $m^{th}$ column are output over S(10m/3).

When G2 is turned on, the sub-pixel data for the $1^{st}$ and $2^{nd}$ rows are written into corresponding sub-pixels through respective data lines. For example, the green sub-pixel data $G_{2,1}$ of $2^{st}$ row, $1^{st}$ column are output over S1, the green sub-pixel data $G_{1,1}$ of $1^{st}$ row, $1^{st}$ column are output over S2, . . . , the white sub-pixel data $W_{2,m}$ of $2^{nd}$ row, $m^{th}$ column are output over S(10m/3−1), and the white sub-pixel data $W_{1,m}$ of $1^{st}$ row, $m^{th}$ column are output over S(10m/3).

When G3 is turned on, the sub-pixel data for the $1^{st}$ and $2^{nd}$ rows are written into corresponding sub-pixels through respective data lines. For example, the blue sub-pixel data $B_{1,1}$ of $1^{st}$ row, $1^{st}$ column are output over S1, the blue sub-pixel data $B_{2,1}$ of $2^{nd}$ row, $1^{st}$ column are output over S2, . . . , the yellow sub-pixel data $Y_{1,m}$ of $1^{st}$ row, $m^{th}$ column are output over S(10m/3−1), and the yellow sub-pixel data $Y_{2,m}$ of $2^{nd}$ row, $m^{th}$ column are output over S(10m/3).

. . .

When G(1.5n−2) is turned on, the sub-pixel data for the $n-1^{th}$ and $n^{th}$ rows are written into corresponding sub-pixels through respective data lines. For example, the red sub-pixel data $R_{n-1,1}$ of $n-1^{th}$ row, $1^{st}$ column are output over S1, the red sub-pixel data $R_{n,1}$ of $n^{th}$ row, $1^{st}$ column are output over S2, . . . , the blue sub-pixel data $B_{n-1,m}$ of $n-1^{th}$ row, $m^{th}$ column are output over S(10m/3−1), and the blue sub-pixel data $B_{n,m}$ of $n^{th}$ row, $m^{th}$ column are output over S(10m/3).

When G(1.5n−1) is turned on, the sub-pixel data for the $n-1^{th}$ and $n^{th}$ rows are written into corresponding sub-pixels through respective data lines. For example, the green sub-pixel data $G_{n,1}$ of $n^{th}$ row, $1^{st}$ column are output over S1, the green sub-pixel data $G_{n-1,1}$ of $n-1^{th}$ row, $1^{st}$ column are output over S2, . . . , the white sub-pixel data $W_{n,m}$ of $n^{th}$ row, $m^{th}$ column are output over S(10m/3−1), and the white sub-pixel data $W_{n-1,m}$ of $n-1^{th}$ row, $m^{th}$ column are output over S(10m/3).

When G(1.5n) is turned on, the sub-pixel data for the $n-1^{th}$ and $n^{th}$ rows are written into corresponding sub-pixels through respective data lines. For example, the blue sub-pixel data $B_{n-1,1}$ of $n-1^{th}$ row, $1^{st}$ column are output over S1, the blue sub-pixel data $B_{n,1}$ of $n^{th}$ row, $1^{st}$ column are output over S2, . . . , the yellow sub-pixel data of $n-1^{th}$ row, $m^{th}$ column are output over S(10m/3−1), and the yellow sub-pixel data $Y_{n,m}$ of $n^{th}$ row, $m^{th}$ column are output over S(10m/3).

It is assumed that the frame frequency is 60 Hz, charging time for each pixel unit of the dual-gate driven liquid crystal display device is 1/(60*2n)s, and charging time for each pixel unit of the triple-gate driven liquid crystal display device is 1/(60*3n)s. While in this example, the charging time for each pixel unit of the liquid crystal display device is 1/(60*1.5n)s.

Figure 18:
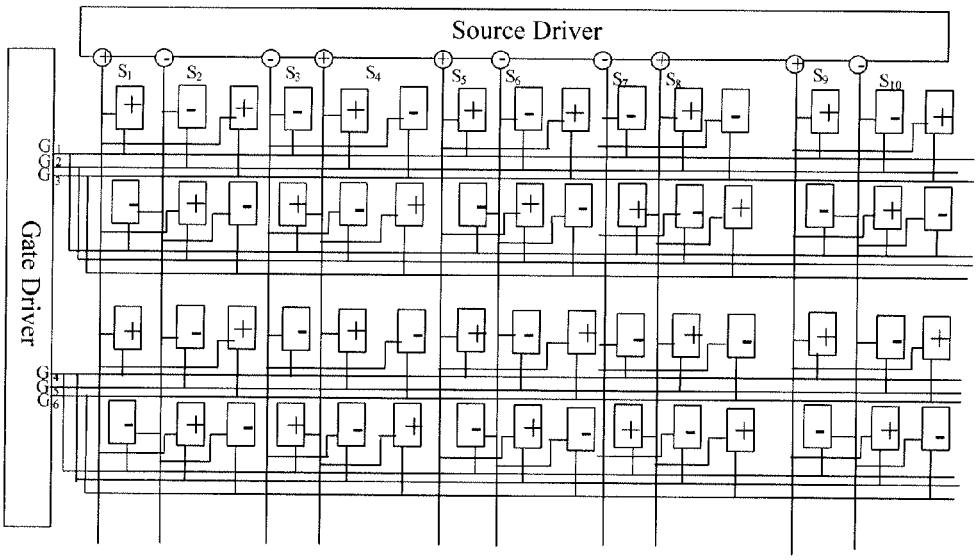
FIGS. 18 and 19 are a pixel array schematic diagrams of pixel polarity reversal for two adjacent frames of pictures where adopting red, green, blue, yellow and white five primary colors in the present invention.
Figure 19:
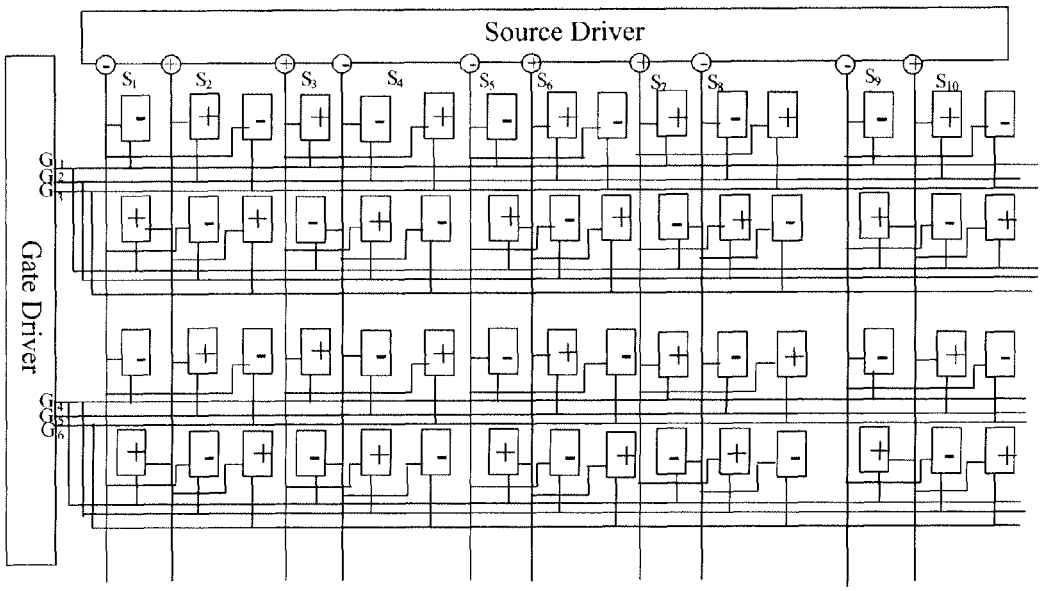

As illustrated in FIGS. 18 and 19, in order to realize the dot inversion for the entire picture, in the same frame of picture, pixels on a same data line have a same polarity, pixels on the $4g-3^{th}$ and the $4g-2^{th}$ data lines have opposite polarities to each other, pixels on the $4g-1^{th}$ and the $4g^{th}$ data lines have opposite polarities to each other, pixels on the $4g-3^{th}$, $4g-2^{th}$, $4g-1^{th}$ and $4g^{th}$ data lines have polarities of "positive, negative, negative, positive" ("+−−+") or "negative, positive, positive, negative" ("−++−"), wherein g is an integer greater than or equal to 1 and less than or equal to 5m/6. For different frames of pictures, pixels on the same data lines have opposite polarities.

Display panels of the embodiments of the present invention may also be applicable to other types of displays, such as organic luminescence display (OLED), including, but not limited to, a display panel, a source driver and a gate driver; the display panel is the display panel described in any of the above-mentioned embodiments; the source driver is connected with the data lines for providing data signals to the display panel; the gate driver is connected with the scan lines for providing scanning signal to the display panel.

The above is only exemplary implementations of the present invention, rather than for limiting protection scope of the present invention, which is defined by the appended claims.

The invention claimed is:

1. A display panel comprising:

a plurality of data lines;

a plurality of scan lines;

a plurality of sub-pixels arranged in matrix;

wherein, three scan lines are disposed between every two rows of sub-pixels, and one column of data line is disposed for every one column or between two columns of sub-pixels;

a first scan line in every 3 adjacent scan lines is connected with a first color of sub-pixel in every 3 adjacent sub-pixels in an odd numbered row and an even numbered row of sub-pixels neighboring the first scan line;

a second scan line in the every 3 adjacent scan lines is connected with a second color of sub-pixel in every 3 adjacent sub-pixels in the odd numbered row and the even numbered row of sub-pixels neighboring the second scan line; and a third scan line in the every 3 adjacent scan lines is connected with a third color of sub-pixel in every 3 adjacent sub-pixels in the odd numbered row and the even numbered row of su-pixels neighboring the third scan line.

2. The display panel of claim 1, wherein one data line is disposed on each of the left and right sides of the first column of sub-pixels in 3 adjacent columns of sub-pixels.

3. The display panel of claim 1, wherein a number of the data lines is less than or equal to ⅔ of a number of sub-pixels in row direction; and a number of the scan lines is greater than or equal to 3/2 of a number of sub-pixels in column direction.

4. The display panel of claim 1, wherein the first scan line in every 3 adjacent scan lines is connected with a first sub-pixel in every 3 adjacent sub-pixels in the odd numbered row and the even numbered row of sub-pixels neighboring the first scan line;

the second scan line in the every 3 adjacent scan lines is connected with a second sub-pixel in every 3 adjacent sub-pixels in the odd numbered row and the even numbered row of sub-pixels neighboring the second scan line; and the third scan line in the every 3 adjacent scan lines is connected with a third sub-pixel in every 3 adjacent sub-pixels in the odd numbered row and the even numbered row of sub-pixels neighboring the third scan line.

5. The display panel of claim 4, wherein an odd numbered column of data lines is connected with every 3 adjacent sub-pixels in an odd numbered row of sub-pixels; and an even numbered column of data lines is connected with every 3 adjacent sub-pixels in an even numbered row of sub-pixels.

6. The display panel of claim 5, wherein the odd numbered column of data lines being connected with the every 3 adjacent sub-pixels in the odd numbered row of sub-pixels and the even numbered column of data lines being connected with the every 3 adjacent sub-pixels in the even numbered row of sub-pixels comprises:

the $2k-1^{th}$ data line S(2k−1) is connected with sub-pixels of the $3k-2^{th}$, $3k-1^{th}$ and $3k^{th}$ columns of the odd numbered row of sub-pixels in the sub-pixel matrix; and the $2k^{th}$ data line S(2k) is connected with sub-pixels of the $3k-2^{th}$, $3k-1^{th}$, and $3k^{th}$ columns of the even numbered rows of sub-pixels in the sub-pixel matrix, wherein k is an integer greater than or equal to 1 and less than or equal to M*m/3.

7. The display panel of claim 5, further comprising a timing control circuit;

in a frame of picture, when the timing control circuit controls the $1^{st}$ scan line in every 3 adjacent scan lines to turn on, an odd numbered column of data lines writes data into the $1^{st}$ sub-pixel in the every 3 adjacent sub-pixels in an odd numbered row of sub-pixels connected with the $1^{st}$ scan line, an even numbered column of data lines writes data into the $1^{st}$ sub-pixel in the every 3 adjacent sub-pixels in an even numbered row of sub-pixels connected with the $1^{st}$ scan line;

when the timing control circuit controls the $2^{nd}$ scan line in the every 3 adjacent scan lines to turn on, the odd numbered column of data lines writes data into the $2^{nd}$ sub-pixel in the every 3 adjacent sub-pixels in the odd numbered row of sub-pixels connected with the 2nd scan line, the even numbered column of data lines writes data into the $2^{nd}$ sub-pixel in the every 3 adjacent sub-pixels in the even numbered row of sub-pixels connected with the $2^{nd}$ scan line; and when the timing control circuit controls the $3^{rd}$ scan line in every 3 adjacent scan lines to turn on, the odd numbered column of data lines writes data into the $3^{rd}$ sub-pixel in the every 3 adjacent sub-pixels in the odd numbered row of sub-pixels connected with the $3^{rd}$ scan line, the even numbered column of data lines writes data into the $3^{rd}$ sub-pixel in the every 3 adjacent sub-pixels in the even numbered row of sub-pixels connected with the $3^{rd}$ scan line.

8. The display panel of claim 4, wherein an odd numbered column of data lines is connected with a first and a third sub-pixels in every 3 adjacent sub-pixels in an odd numbered row of sub-pixels and a second sub-pixel in every 3 adjacent sub-pixels in an even numbered row of sub-pixels; and an even numbered column of data fines is connected with a first and a third sub-pixels in the every 3 adjacent sub-pixels in the even numbered row of sub-pixels and a second sub-pixel in the every 3 adjacent sub-pixels in the odd numbered row of sub-pixels.

9. The display panel of claim 8, wherein the $2k-1^{th}$ data line S(2k−1) is connected with the sub-pixels of the $3k-2^{th}$ and $3k^{th}$ columns of the odd numbered rows of sub-pixels and the sub-pixels of the $3k-1^{th}$ column of the even numbered row of sub-pixels in the sub-pixel matrix; and the $2k^{th}$ data line S(2k) is connected with the sub-pixels of the $3k-1^{th}$ column of the odd numbered rows of sub-pixels, and the sub-pixels of the $3k-2^{th}$ and the $3k^{th}$ columns of the even numbered rows of sub-pixels in the sub-pixel matrix, wherein k is an integer greater than or equal to 1 and less than or equal to M*m/3.

10. The display panel of claim 8, wherein in the same frame of picture, pixels on a same data line have a same polarity, pixels on the $4g-3^{th}$ and the $4g-2^{th}$ data lines have opposite polarities to each other, pixels on the $4g-1^{th}$ and the $4g^{th}$ data lines have opposite polarities to each other, pixels on the $4g-3^{th}$, $4g-2^{th}$, $4g-1^{th}$ and $4g^{th}$ data lines have polarities of "positive, negative, negative, positive" or "negative, positive, positive, negative", and wherein g is an integer greater than or equal to 1 and less than or equal to M*m/6, and in a current frame of picture and a next frame picture, pixels on the same data lines have opposite polarities.

11. The display panel of claim 8, further comprising a timing control circuit;

in a frame of picture, when the timing control circuit controls the $1^{st}$ scan line in every 3 adjacent scan lines to turn on, an odd numbered column of data lines writes data into the $1^{st}$ sub-pixel in the every 3 adjacent sub-pixels in an odd numbered row of sub-pixels connected with the $1^{st}$ scan line, an even numbered column of data lines writes data into the $1^{st}$ sub-pixel in the every 3 adjacent sub-pixels in an even numbered row of sub-pixels connected with the $1^{st}$ scan line;

when the timing control circuit controls the $2^{nd}$ scan line in the every 3 adjacent scan lines to turn on, the odd numbered column of data lines writes data into the $2^{nd}$ sub-pixel in the every 3 adjacent sub-pixels in the odd numbered row of sub-pixels connected with the $2^{nd}$ scan line, the even numbered column of data lines writes data into the $2^{nd}$ sub-pixel in the every 3 adjacent sub-pixels in the even numbered row of sub-pixels connected with the 2nd scan line; and when the timing control circuit controls the $3^{rd}$ scan line in every 3 adjacent scan lines to turn on, the odd numbered column of data lines writes data into the $3^{rd}$ sub-pixel in the every 3 adjacent sub-pixels in the odd numbered row of sub-pixels connected with the $3^{rd}$ scan line, the even numbered column of data lines writes data into the $3^{rd}$ sub-pixel in the every 3 adjacent sub-pixels in the even numbered row of sub-pixels connected with the $3^{rd}$ scan line.

12. The display panel of claim 4, wherein a group of n rows and m columns of sub-pixels corresponds to n rows and M*m columns of sub-pixel in matrix;

for sub-pixels of the $i^{th}$ and the i+1th rows, the 3j+1th column of sub-pixels are connected with the $(3i-1)/2^{th}$ scan line G ((3i−1)/2), the $3j+2^{th}$ column of sub-pixels are connected with a $(3i+1)/2^{th}$ scan line G ((3i+1)/2) and the $3j+3^{th}$ column of sub-pixels are connected with the $(3i+3)/2^{th}$ scan line G ((3i+3)/2);

wherein n is an even number, i is an odd number greater than or equal to 1 and less than or equal to n−1, j is an integer greater than or equal to 0 and less than or equal to (M*m/3)−1, and M equals to the number of primary colors of the display panel.

13. The display panel of claim 12, wherein the display panel uses three primary colors of red, green and blue, four primary colors of red, green, blue and white, four primary odors of red, green, blue and yellow, or five primary colors of red, green, blue, yellow and white; and M equals to 3, 4 or 5.

14. The display panel of claim 1, wherein in the display panel, an inversion mode for the sub-pixels is dot inversion.

15. A display comprising:

the display panel of claim 1;

a source driver;

a gate driver;

wherein the source driver is connected with the data lines for providing data signals to the display panel; and the gate driver is connected with the scan lines for providing scanning signals to the display panel.

* * * * *